US012782096B2

(12) United States Patent
Todorov

(10) Patent No.: US 12,782,096 B2
(45) Date of Patent: Nov. 3, 2026

(54) MUNITIONS PACKAGING SYSTEM

(71) Applicant: Machinehead LTD., Plovdiv (BG)

(72) Inventor: Elin Todorov, Plovdiv (BG)

(73) Assignee: Machinehead LTD., Plovdiv (BG)

( * ) Notice: Subject to any disclaimer, the term of this patent is extended or adjusted under 35 U.S.C. 154(b) by 0 days.

(21) Appl. No.: 18/666,003

(22) Filed: May 16, 2024

(65) Prior Publication Data

US 2025/0189284 A1 Jun. 12, 2025

Related U.S. Application Data

(60) Provisional application No. 63/607,839, filed on Dec. 8, 2023.

(51) Int. Cl.
*F42B 39/26* (2006.01)
*F42B 39/00* (2006.01)

(52) U.S. Cl.
CPC ..... *F42B 39/26* (2013.01)

(58) Field of Classification Search
CPC ..... A47F 1/126; A47F 10/00; A47F 10/02; A47F 2010/025; A47F 3/001; A47F 3/04; A47F 5/0037; A47F 7/0071; B65D 1/02; B65D 1/0207; B65D 1/0215; B65D 1/0223; B65D 1/023; B65D 1/0246; B65D 1/0261; B65D 1/0276; B65D 1/0284;

(Continued)

(56) References Cited

U.S. PATENT DOCUMENTS 2,838,173 A * 6/1958 Emery ..... B65D 81/133 229/87.01
3,465,871 A * 9/1969 McDaniel ..... F41F 3/042 220/920

(Continued)

FOREIGN PATENT DOCUMENTS

CH 717243 A2 * 9/2021 ..... G04B 19/042
CN 106342166 B * 11/2014 ..... F42B 39/26

(Continued)

OTHER PUBLICATIONS

Arsenal SAM7K Series Pistol Hard Case CNC Hard Foam Liner TSA Locks ; K-VAR Corp. ; https://www.k-var.com/arsenal-hard-case-sam7k-tsa-locks ; 7 Pages.

*Primary Examiner* — Anthony D Stashick
*Assistant Examiner* — Marcos Javier Rodriguez Molina
(74) *Attorney, Agent, or Firm* — Oblon, McClelland, Maier & Neustadt, L.L.P.

(57) ABSTRACT

A system and method for packaging and storing munitions includes a packaging device having an upper portion and a lower portion. The upper and lower portions include a mating indents complementary to fit together in interlocking manner. The upper and lower portions further include one or more first indents to form one or more cavities for storage and protection of one or more munitions within the munitions packaging system when the upper and lower portions are mated. The upper portion and the lower portion are made of a first single polymer material. The system further comprises one or more interposing stacking layers. The method (Continued)

involves placing one or more munitions in a munitions packaging system, assembling an upper portion, lower portion, and optional interposing stacking layers.

14 Claims, 18 Drawing Sheets

(58) Field of Classification Search
CPC ..... B65D 1/0292; B65D 1/12; B65D 1/16; B65D 1/20; B65D 1/22; B65D 1/225; B65D 1/26; B65D 1/32; B65D 1/36; B65D 1/40; B65D 11/02; B65D 11/10; B65D 11/12; B65D 11/18; B65D 11/20; B65D 11/24; B65D 13/04; B65D 17/34; B65D 17/4012; B65D 19/00; B65D 19/0018; B65D 19/0026; B65D 19/0028; B65D 19/0036; B65D 19/0069; B65D 19/0073; B65D 19/02; B65D 19/06; B65D 19/18; B65D 19/38; B65D 19/385; B65D 19/40; B65D 19/44; B65D 21/00; B65D 21/0202; B65D 21/0204; B65D 21/0206; B65D 21/0209; B65D 21/0212; B65D 21/0213; B65D 21/0215; B65D 21/0216; B65D 21/0222; B65D 21/0223; B65D 21/0231; B65D 21/0235; B65D 21/04; B65D 21/086; B65D 2201/00; B65D 2203/00; B65D 2203/02; B65D 2203/06; B65D 2203/08; B65D 2203/10; B65D 2203/12; B65D 2205/00; B65D 2205/02; B65D 2207/00; B65D 2211/00; B65D 2213/02; B65D 2215/02; B65D 2251/0006; B65D 2251/0015; B65D 2251/0018; B65D 2251/0025; B65D 2251/0068; B65D 2251/0087; B65D 2251/009; B65D 2251/0093; B65D 2251/0096; B65D 2251/1016; B65D 2255/06; B65D 23/00; B65D 23/001; B65D 23/08; B65D 23/085; B65D 23/0885; B65D 23/10; B65D 23/102; B65D 23/106; B65D 23/14; B65D 2301/20; B65D 2313/00; B65D 2313/10; B65D 2401/00; B65D 2401/05; B65D 2401/10; B65D 2401/25; B65D 2401/30; B65D 2401/60; B65D 25/00; B65D 25/02; B65D 25/04; B65D 25/10; B65D 25/101; B65D 25/102; B65D 25/14; B65D 25/16; B65D 25/18; B65D 25/20; B65D 25/205; B65D 25/24; B65D 25/282; B65D 25/2894; B65D 25/32; B65D 25/34; B65D 25/38; B65D 25/54; B65D 25/56; B65D 2501/0018; B65D 2501/0027; B65D 2501/0036; B65D 2501/0081; B65D 2501/24; B65D 2501/24872; B65D 2517/0013; B65D 2517/0052; B65D 2517/0082; B65D 2519/00009; B65D 2519/00019; B65D 2519/00024; B65D 2519/00034; B65D 2519/00039; B65D 2519/00044; B65D 2519/00059; B65D 2519/00064; B65D 2519/00069; B65D 2519/00074; B65D 2519/00079; B65D 2519/00094; B65D 2519/00109; B65D 2519/00114; B65D 2519/00144; B65D 2519/00184; B65D 2519/00218; B65D 2519/00233; B65D 2519/00268; B65D 2519/00273; B65D 2519/00288; B65D 2519/00293; B65D 2519/00298; B65D 2519/00303; B65D 2519/00318; B65D 2519/00323; B65D 2519/00333; B65D 2519/00338; B65D 2519/00373; B65D 2519/00378; B65D 2519/00407; B65D 2519/00437; B65D 2519/00442; B65D 2519/00447; B65D 2519/00497; B65D 2519/00502; B65D 2519/00512; B65D 2519/00522; B65D 2519/00547; B65D 2519/00562; B65D 2519/00567; B65D 2519/00572; B65D 2519/00587; B65D 2519/00641; B65D 2519/00676; B65D 2519/00696; B65D 2519/00711; B65D 2519/00796; B65D 2519/008; B65D 2519/00805; B65D 2519/00815; B65D 2519/0086; B65D 2519/0096; B65D 2519/00965; B65D 2519/0097; B65D 2543/00018; B65D 2543/00046; B65D 2543/00092; B65D 2543/00194; B65D 2543/00203; B65D 2543/00296; B65D 2543/00333; B65D 2543/0037; B65D 2543/00518; B65D 2543/00555; B65D 2543/0062; B65D 2543/00657; B65D 2543/00703; B65D 2543/0074; B65D 2543/00814; B65D 2543/00824; B65D 2543/00972; B65D 2565/385; B65D 2571/00061; B65D 2571/00111; B65D 2575/586; B65D 2577/043; B65D 2581/02; B65D 2583/005; B65D 2583/0486; B65D 2585/647; B65D 2585/687; B65D 2585/6877; B65D 2588/12; B65D 2590/0058; B65D 2590/0066; B65D 2590/0083; B65D 2590/026; B65D 2590/046; B65D 2590/547; B65D 2590/664; B65D 27/00; B65D 27/06; B65D 27/20; B65D 27/22; B65D 29/00; B65D 3/22; B65D 31/02; B65D 31/10; B65D 31/16; B65D 33/00; B65D 33/004; B65D 33/01; B65D 33/02; B65D 33/06; B65D 33/10; B65D 33/16; B65D 33/18; B65D 33/22; B65D 33/30; B65D 35/02; B65D 35/04; B65D 35/10; B65D 35/24; B65D 39/08; B65D 39/084; B65D 41/04; B65D 41/045; B65D 41/22; B65D 41/28; B65D 41/34; B65D 41/3423; B65D 41/3442; B65D 41/3495; B65D 41/62; B65D 43/00; B65D 43/02; B65D 43/0204; B65D 43/0212; B65D 43/0214; B65D 43/0254; B65D 43/0256; B65D 43/0283; B65D 43/06; B65D 43/14; B65D 43/16; B65D 43/162; B65D 43/163; B65D 43/164; B65D 43/167; B65D 43/22; B65D 43/26; B65D 47/06; B65D 47/0838; B65D 47/122; B65D 47/127; B65D 47/20; B65D 47/32; B65D 47/36; B65D 49/12; B65D 5/00; B65D 5/0005; B65D 5/003; B65D 5/0085; B65D 5/0254; B65D 5/2057; B65D 5/325; B65D 5/3635; B65D 5/3685; B65D 5/42; B65D 5/4204; B65D 5/4208; B65D 5/4212; B65D 5/4233; B65D 5/425; B65D 5/44; B65D 5/48002; B65D 5/5028; B65D 5/503; B65D 5/5035; B65D 5/5059; B65D 5/52; B65D 5/5213;

B65D 5/5253; B65D 5/526; B65D 5/5445; B65D 5/5495; B65D 5/606; B65D 5/62; B65D 5/6602; B65D 5/746; B65D 50/04; B65D 50/046; B65D 50/06; B65D 51/00; B65D 51/002; B65D 51/16; B65D 51/1622; B65D 51/1644; B65D 51/18; B65D 51/20; B65D 51/225; B65D 51/24; B65D 51/241; B65D 51/243; B65D 51/244; B65D 51/245; B65D 51/248; B65D 51/249; B65D 51/26; B65D 51/28; B65D 51/2807; B65D 51/2814; B65D 51/2835; B65D 51/285; B65D 51/2864; B65D 51/2871; B65D 51/2878; B65D 51/30; B65D 53/00; B65D 53/02; B65D 53/04; B65D 55/00; B65D 55/02; B65D 55/026; B65D 55/028; B65D 55/06; B65D 55/0818; B65D 55/14; B65D 55/16; B65D 55/165; B65D 61/00; B65D 65/22; B65D 65/38; B65D 65/40; B65D 65/403; B65D 65/406; B65D 65/44; B65D 65/46; B65D 65/466; B65D 7/04; B65D 7/045; B65D 71/0085; B65D 71/0096; B65D 73/0014; B65D 73/0085; B65D 75/00; B65D 75/002; B65D 75/008; B65D 75/20; B65D 75/30; B65D 75/52; B65D 75/525; B65D 75/527; B65D 75/54; B65D 75/566; B65D 75/5811; B65D 75/5816; B65D 75/5833; B65D 75/5838; B65D 75/585; B65D 75/5866; B65D 75/5872; B65D 75/5877; B65D 75/5883; B65D 75/5894; B65D 77/00; B65D 77/006; B65D 77/042; B65D 77/048; B65D 77/0486; B65D 77/06; B65D 77/20; B65D 77/206; B65D 77/225; B65D 77/26; B65D 79/00; B65D 79/0087; B65D 79/02; B65D 81/00; B65D 81/02; B65D 81/022; B65D 81/03; B65D 81/05; B65D 81/051; B65D 81/052; B65D 81/053; B65D 81/09; B65D 81/113; B65D 81/133; B65D 81/18; B65D 81/20; B65D 81/2015; B65D 81/2038; B65D 81/2046; B65D 81/2069; B65D 81/24; B65D 81/261; B65D 81/263; B65D 81/266; B65D 81/32; B65D 81/3216; B65D 81/3222; B65D 81/3227; B65D 81/3233; B65D 81/325; B65D 81/3283; B65D 81/36; B65D 81/361; B65D 81/365; B65D 81/368; B65D 81/38; B65D 81/3802; B65D 81/3806; B65D 81/3811; B65D 81/3813; B65D 81/3816; B65D 81/3818; B65D 81/382; B65D 81/3823; B65D 81/3825; B65D 81/3834; B65D 81/3837; B65D 81/3858; B65D 81/386; B65D 81/3888; B65D 81/3897; B65D 83/00; B65D 83/0094; B65D 83/0409; B65D 83/0481; B65D 83/12; B65D 83/20; B65D 83/306; B65D 83/32; B65D 83/38; B65D 83/384; B65D 83/42; B65D 83/425; B65D 83/46; B65D 83/48; B65D 83/60; B65D 83/62; B65D 83/625; B65D 83/64; B65D 83/643; B65D 83/673; B65D 83/75; B65D 83/771; B65D 83/7713; B65D 85/00; B65D 85/10; B65D 85/18; B65D 85/185; B65D 85/187; B65D 85/20; B65D 85/34; B65D 85/38; B65D 85/42; B65D 85/46; B65D 85/50; B65D 85/505; B65D 85/52; B65D 85/58; B65D 85/62; B65D 85/64; B65D 85/68; B65D 85/70; B65D 85/72; B65D 85/804; B65D 85/84; B65D 88/00; B65D 88/005; B65D 88/02; B65D 88/022; B65D 88/12; B65D 88/121; B65D 88/126; B65D 88/127; B65D 88/128; B65D 88/129; B65D 88/14; B65D 88/1612; B65D 88/1618; B65D 88/1668; B65D 88/1681; B65D 88/22; B65D 88/26; B65D 88/30; B65D 88/32; B65D 88/36; B65D 88/524; B65D 88/54; B65D 88/546; B65D 88/56; B65D 88/70; B65D 88/72; B65D 88/74; B65D 88/744; B65D 88/745; B65D 88/78; B65D 9/22; B65D 90/00; B65D 90/0006; B65D 90/0013; B65D 90/0033; B65D 90/004; B65D 90/0046; B65D 90/0053; B65D 90/006; B65D 90/0066; B65D 90/0073; B65D 90/008; F42B 1/00; F42B 1/02; F42B 1/028; F42B 1/036; F42B 10/06; F42B 10/14; F42B 10/26; F42B 10/30; F42B 10/38; F42B 10/48; F42B 10/58; F42B 10/60; F42B 12/06; F42B 12/10; F42B 12/207; F42B 12/36; F42B 12/365; F42B 12/38; F42B 12/385; F42B 12/387; F42B 12/40; F42B 12/44; F42B 12/46; F42B 12/48; F42B 12/50; F42B 12/56; F42B 12/58; F42B 12/60; F42B 12/62; F42B 12/64; F42B 12/66; F42B 12/68; F42B 12/70; F42B 12/76; F42B 15/00; F42B 15/01; F42B 15/08; F42B 15/10; F42B 15/105; F42B 15/20; F42B 15/36; F42B 15/38; F42B 17/00; F42B 19/12; F42B 19/26; F42B 19/44; F42B 22/00; F42B 22/04; F42B 23/00; F42B 23/005; F42B 23/04; F42B 23/16; F42B 23/24; F42B 25/00; F42B 27/00; F42B 3/00; F42B 3/08; F42B 3/087; F42B 3/093; F42B 3/10; F42B 3/12; F42B 3/121; F42B 3/13; F42B 3/14; F42B 3/18; F42B 3/195; F42B 3/24; F42B 3/26; F42B 3/28; F42B 33/00; F42B 33/001; F42B 33/0207; F42B 33/04; F42B 33/06; F42B 33/067; F42B 35/00; F42B 35/02; F42B 39/00; F42B 39/14; F42B 39/16; F42B 39/20; F42B 39/22; F42B 39/24; F42B 39/26; F42B 39/30; F42B 4/00; F42B 4/04; F42B 4/06; F42B 4/08; F42B 4/12; F42B 4/16; F42B 4/20; F42B 4/22; F42B 4/24; F42B 4/30; F42B 5/02; F42B 5/105; F42B 5/155; F42B 5/16; F42B 5/181; F42B 5/188; F42B 5/192; F42B 5/38; F42B 6/003; F42B 6/08; F42B 8/24; F42B 8/26; F42B 99/00; F42B 3/02; F42B 30/08; A24F 15/00; A47B 47/047; A47B 81/005; E02B 11/005; E03F 3/02; F16L 1/028; F16L 3/2235; F41A 9/09; F41F 3/042; Y02W 90/10; Y10S 206/821; Y10S 220/92

USPC ..... 205/3; 206/1.5, 216, 219, 221, 222, 223, 206/232, 279, 297, 3, 307, 308.1, 308.2, 206/317, 322, 429, 438, 449, 459.1,

206/459.5, 503, 508, 509, 514, 523, 206/524.1, 524.3, 524.6, 524.7, 533, 539, 206/568, 719, 819, 5, 6, 82, 83, 1.7, 1.8, 206/139, 140, 141, 144, 145, 147, 148, 206/149, 15.2, 15.3, 150, 151, 153, 154, 206/155, 158, 159, 161, 162, 170, 175, 206/192, 193, 194, 196, 197, 199, 203, 206/204, 205, 207, 209, 209.1, 210, 206/213.1, 214, 217, 218, 220, 224, 225, 206/226, 227, 228, 229, 233, 235, 236, 206/242, 246, 256, 264, 265, 268, 270, 206/273, 277, 278, 281, 292, 303, 304, 206/305, 306, 307.1, 308.3, 309, 310, 206/311, 312, 313, 315.1, 315.11, 315.2, 206/315.3, 315.4, 315.5, 315.6, 315.7, 206/315.9, 316.1, 318, 319, 320, 321, 206/335, 338, 339, 348, 349, 350, 361, 206/362, 362.1, 362.2, 363, 364, 365, 206/366, 368, 369, 37, 370, 371, 372, 206/373, 379, 38, 380, 384, 385, 386, 206/387.1, 387.13, 388, 389, 390, 391, 206/392, 394, 395, 396, 397, 398, 400, 206/403, 404, 405, 407, 408, 409, 410, 206/411, 412, 413, 416, 418, 419, 423, 206/425, 426, 427, 428, 430, 431, 432, 206/433, 434, 436, 439, 440, 441, 443, 206/445, 446, 447, 45.2, 45.23, 45.24, 206/454, 455, 456, 457, 460, 461, 462, 206/463, 464, 466, 467, 468, 469, 470, 206/471, 472, 476, 477, 480, 482, 484, 206/484.1, 484.2, 485, 486, 488, 493, 206/494, 495, 497, 499, 5.1, 500, 501, 206/504, 505, 506, 507, 510, 511, 512, 206/515, 516, 518, 519, 520, 521, 521.1, 206/522, 524, 524.2, 524.4, 524.5, 524.8, 206/525, 526, 527, 528, 529, 53, 530, 206/531, 532, 534, 534.1, 535, 536, 538, 206/540, 541, 542, 545, 546, 549, 551, 206/553, 554, 557, 558, 560, 561, 562, 206/563, 564, 565, 569, 570, 571, 572, 206/575, 576, 577, 579, 581, 583, 584, 206/585, 586, 587, 588, 589, 590, 591, 206/592, 593, 594, 595, 597, 598, 599, 206/6.1, 600, 63.3, 63.5, 69, 701, 702, 206/703, 705, 710, 711, 714, 718, 722, 206/723, 725, 736, 756, 763, 769, 77.1, 206/775, 776, 778, 779, 784, 8, 802, 803, 206/804, 805, 806, 807, 811, 812, 813, 206/814, 815, 817, 818, 820, 821, 822, 206/823, 828, 83.5, 830, 831, 86; 220/1.5, 200, 203.08, 212, 23.83, 23.87, 220/23.89, 258.1, 268, 270, 281, 284, 220/288, 296, 324, 359.1, 4.15, 4.21, 220/4.27, 475, 507, 509, 560.01, 560.03, 220/560.04, 560.1, 560.11, 560.12, 220/560.13, 560.15, 561, 563, 565, 581, 220/582, 589, 590, 592, 592.2, 592.21, 220/592.24, 592.26, 592.27, 6, 606, 220/62.11, 62.19, 647, 649, 654, 675, 220/681, 683, 705, 708, 710, 88.1, 900, 220/901, 902, DIG. 14, DIG. 23, 1.6, 220/2.1 R, 2.3 R, 201, 202, 203.01, 220/203.04, 203.07, 203.09, 203.1, 220/203.11, 203.12, 203.13, 203.16, 220/203.17, 203.18, 203.19, 203.23, 220/203.26, 203.28, 203.29, 210, 211, 220/212.5, 213, 214, 215, 216, 222, 228, 220/229, 23.2, 23.4, 23.6, 23.8, 23.86, 220/23.88, 23.9, 23.91, 230, 231, 232, 220/233, 234, 235, 240, 242, 243, 244, 220/251, 252, 253, 254.1, 254.2, 254.3, 220/254.4, 254.5, 254.6, 254.7, 254.8, 220/254.9, 255, 255.1, 256.1, 257.1, 220/257.2, 258.2, 258.3, 258.4, 258.5, 220/259.1, 259.2, 259.3, 259.4, 259.5, 220/261, 262, 263, 264, 265, 266, 267, 220/269, 271, 272, 273, 274, 275, 276, 220/277, 278, 279, 282, 283, 285, 287, 220/289, 291, 293, 295, 297, 298, 300, 220/301, 302, 303, 304, 305, 309.1, 220/309.2, 310.1, 314, 315, 316, 318, 220/319, 320, 321, 322, 323, 325, 326, 220/327, 328, 345.1, 345.2, 345.3, 345.4, 220/345.6, 348, 350, 351, 359.2, 359.3, 220/359.4, 360, 361, 363, 366.1, 367.1, 220/369, 371, 372, 373, 374, 375, 376, 220/377, 378, 379, 380, 4.01, 4.03, 4.04, 220/4.05, 4.06, 4.07, 4.09, 4.12, 4.13, 220/4.14, 4.16, 4.22, 4.23, 4.24, 4.25, 220/4.26, 4.28, 4.29, 4.33, 4.34, 476, 480, 220/481, 483, 484, 485, 495, 495.01, 220/495.02, 495.03, 495.04, 495.05, 220/495.06, 495.07, 495.08, 495.09, 220/495.11, 500, 501, 502, 503, 504, 505, 220/506, 510, 516, 519, 520, 521, 522, 220/523, 524, 525, 526, 527, 528, 530, 220/532, 533, 553, 554, 555, 556, 558, 220/560, 560.02, 560.05, 560.06, 560.07, 220/560.08, 560.09, 562, 564, 567, 567.1, 220/567.2, 568, 570, 571, 571.1, 573, 220/573.1, 573.4, 574, 574.1, 574.2, 575, 220/576, 577, 578, 583, 584, 585, 586, 220/588, 591, 592.01, 592.02, 592.03, 220/592.09, 592.14, 592.16, 592.17, 220/592.18, 592.19, 592.22, 592.23, 220/592.25, 592.28, 600, 601, 602, 603, 220/604, 605, 608, 609, 610, 611, 612, 220/613, 614, 615, 616, 617, 618, 619, 220/62, 62.12, 62.13, 62.14, 62.15, 62.16, 220/62.17, 62.18, 62.2, 62.21, 62.22, 620, 220/621, 622, 623, 624, 625, 626, 627, 220/628, 629, 630, 631, 632, 633, 634, 220/635, 636, 638, 639, 640, 641, 642, 220/643, 645, 646, 648, 650, 651, 652, 220/653, 656, 657, 658, 659, 660, 661, 220/662, 663, 665, 666, 667, 668, 669, 220/670, 671, 672, 673, 674, 676, 677, 220/678, 680, 682, 686, 689, 692, 694, 220/695, 696, 697, 698, 699, 7, 700, 701; 89/36.01, 918; 109/49.5; 138/106, 108, 138/110, 149; 217/26.5, 27; 229/406, 229/87.01; 248/346.02, 68.1

See application file for complete search history.

(56) References Cited

U.S. PATENT DOCUMENTS 4,195,732 A * 4/1980 Bell ..... B65D 19/44 206/443
5,499,716 A * 3/1996 Gardner ..... B65D 71/70 206/553

(56) References Cited

U.S. PATENT DOCUMENTS

| | | | | |
|---|---|---|---|---|
| 6,209,839 | B1 * | 4/2001 | O'Malley | B65D 71/70 248/346.02 |
| 7,490,630 | B2 * | 2/2009 | Coupe | E03F 3/02 138/108 |
| 10,435,218 | B1 * | 10/2019 | Little | F42B 39/14 |
| 10,717,589 | B2 * | 7/2020 | Lu | B65D 85/20 |
| 2008/0053843 | A1 * | 3/2008 | Edwards | F42B 39/26 206/3 |

FOREIGN PATENT DOCUMENTS

| | | | | | |
|---|---|---|---|---|---|
| CN | 212870935 | U | * | 4/2021 | F42B 39/26 |
| CN | 213229493 | U | | 5/2021 | |
| CN | 116294852 | A | * | 6/2023 | F42B 39/26 |
| FR | 1594272 | A | * | 12/1968 | F42B 39/00 |
| GB | 2092992 | A | * | 8/1982 | F42B 39/26 |
| KR | 101425670 | B1 | * | 8/2014 | F42B 39/26 |
| KR | 20140111838 | A | * | 9/2014 | F42B 39/26 |
| KR | 10-2014-0005955 | U | | 11/2014 | |
| KR | 200477811 | Y1 | * | 7/2015 | B65D 85/20 |
| WO | WO-2018089236 | A1 | * | 5/2018 | B65D 25/20 |

* cited by examiner

MUNITIONS PACKAGING SYSTEM

CROSS-REFERENCE TO RELATED APPLICATIONS

This application claims the benefit of priority to provisional application No. 63/607,839 filed Dec. 8, 2023, the entire contents of which are incorporated herein by reference.

BACKGROUND

Field of the Invention

The present disclosure is directed to a munitions packaging system preferably made of a single lightweight polymer material including expanded polystyrene with no need for other packing materials or dunnage materials, and a method of using the munitions packaging system to transport munitions.

Description of Related Art

The "background" description provided herein is for the purpose of generally presenting the context of the disclosure. Work of the presently named inventors, to the extent it is described in this section, as well as aspects of the description which may not otherwise qualify as prior art at the time of filing, are neither expressly or impliedly admitted as prior art against the present invention.

Conventional munitions packaging systems were made using wood, plastic, and metal. The munitions packaging systems made of wood or metal can be sturdy, but they pose disadvantages such as a heavy weight, high manufacturing and transportation costs, inappropriateness of storage in certain environments, ease of identification by surveillance, compatibility with delicate or sensitive containment areas and challenges in disposal. On the other hand, plastic munitions packaging systems, while light weight and manufactured at relatively low cost, are relatively nondurable. In addition, the above-mentioned wooden, metallic, and plastic munition packages require secondary inner materials in order to secure munitions and explosives in safe manner, which result in further increased manufacturing costs and disposal concerns.

Moreover, dense materials such as metal and wood are known to provide a detectable and substantial heat signature to infrared viewing devices. On the battlefield, conventional munitions packaging systems may be readily apparent and identifiable using observation devices such as FLIR (a forward-looking infrared).

Each of the aforementioned conventional munitions packaging systems suffers from one or more drawbacks hindering their use in the field. Accordingly, it is one object of the present disclosure to provide methods and systems for a munitions packaging system that is light weight, durable, and easy to dispose/recycle, has low manufacturing and transportation cost, is capable of a long-term storage in open air environments, and is difficult to detect using conventional observation and surveillance devices.

SUMMARY

In an exemplary embodiment, a munitions packaging system comprises an upper portion having a first inner surface, a first outer surface, and a plurality of upper portion side surfaces; and a lower portion having a second inner surface, a second outer surface, and a plurality of lower portion side surfaces; wherein the first inner surface of the upper portion and the second inner surface of the lower portion include a plurality of mating indents complementary to fit together in interlocking manner; wherein the first and second inner surfaces include one or more first indents to form one or more cavities for storage and protection of one or more munitions within the munitions packaging system when the upper portion and lower portion are mated; and wherein an entire munitions packaging system consists of a first single polymer material.

In another exemplary embodiment, the first and second outer surfaces include a plurality of nesting indents.

In another exemplary embodiment, the plurality of nesting indents includes alternating convexes and concaves complimentary to each other to stack a plurality of munitions packaging systems.

In another exemplary embodiment, the plurality of nesting indents is cylindrical and located at regular intervals.

In one aspect of the present disclosure, the first single polymer material is an expanded polystyrene having a first average molecular weight between 150,000 g/mol and 400,000 g/mol.

In another aspect of the present disclosure, the munitions packaging system further comprises one or more interposing stacking layers each having a first thickness and a first circumferential dimension substantially same with a second circumferential dimension of the upper portion and the lower portion; wherein each of the one or more interposing stacking layers includes one or more second indents to form the one or more cavities for storage and protection of the one or more munitions within the munitions packaging system when the upper portion, the lower portion, and the one or more interposing stacking layers are mated.

In an exemplary embodiment, the one or more interposing stacking layers consist of the first single polymer material.

In another exemplary embodiment, the one or more interposing stacking layers consist of a second single polymer material.

In one aspect of the present disclosure, the second single polymer material is an expanded polystyrene having a second average molecular weight between 150,000 g/mol and 400,000 g/mol different from the first average molecular weight.

In another aspect of the present disclosure, each cavity of the one or more cavities has a first section and a second section and wherein the first section and the second section are separated with one or more separators consisting of the first single polymer material.

In yet another aspect of the present disclosure, the munitions packaging system includes a plurality of groups of securing indents disposed circumferentially around the munitions packaging system, wherein the plurality of groups of securing indents is symmetrically placed on opposite sides of the munitions packaging system.

In an exemplary embodiment, the one or more munitions is selected from the group consisting of a warhead, a propellant section, a fixed-type munition, a propellant charge, an explosive charge, a sub munition, a guidance kit, and an armed mortar round, wherein each cavity of the one or more cavities has a shape configured to fit each one or more munitions.

In another exemplary embodiment, the munitions packaging system further comprises an electronic tracking device.

In yet another exemplary embodiment the electronic tracking device is a plurality of Radio Frequency Identification (RFID) devices.

In one aspect of the present disclosure, the upper portion further includes a first RFID device of the plurality of RFID devices; wherein the lower portion further includes a second RFID device of the plurality of RFID devices; wherein the first and second RFID devices are configured to provide packaging information about the munitions packaging system; and wherein the packaging information includes an open-closed status, a tracking information, a munition information, and a specification of the munition packaging system.

In another aspect of the present disclosure, the upper portion and the lower portion further comprise a one or more hinges consisting of the first single polymer material disposed on at least one edge.

In an exemplary embodiment, each cavity of the one or more cavities has a first section and a second section; wherein the first section and the second sections are separated with one or more separators consisting of the first single polymer material; wherein each separator of the one or more separators has a second thickness substantially same as the first thickness; wherein the munitions packaging system includes a plurality of groups of securing indents disposed circumferentially around the munitions packaging system symmetrically placed on opposite sides of the munitions packaging system; wherein the one or more munitions are selected from the group consisting of a warhead, a propellant section, a fixed-type munition, a propellant charge, an explosive charge, a sub munition, a guidance kit, and an armed mortar round; wherein each cavity of the one or more cavities has the shape configured to fit each one or more munitions; wherein the upper portion further includes a first RFID device of a plurality of RFID devices; wherein the lower portion further includes a second RFID device of the plurality of RFID devices; wherein the first and second RFID devices are configured to provide packaging information about the munitions packaging system; and wherein the plurality of information includes an open-closed status, a tracking information, a munition information, and a specification of the munition packaging system.

The foregoing general description of the illustrative embodiments and the following detailed description thereof are merely exemplary aspects of the teachings of this disclosure, and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
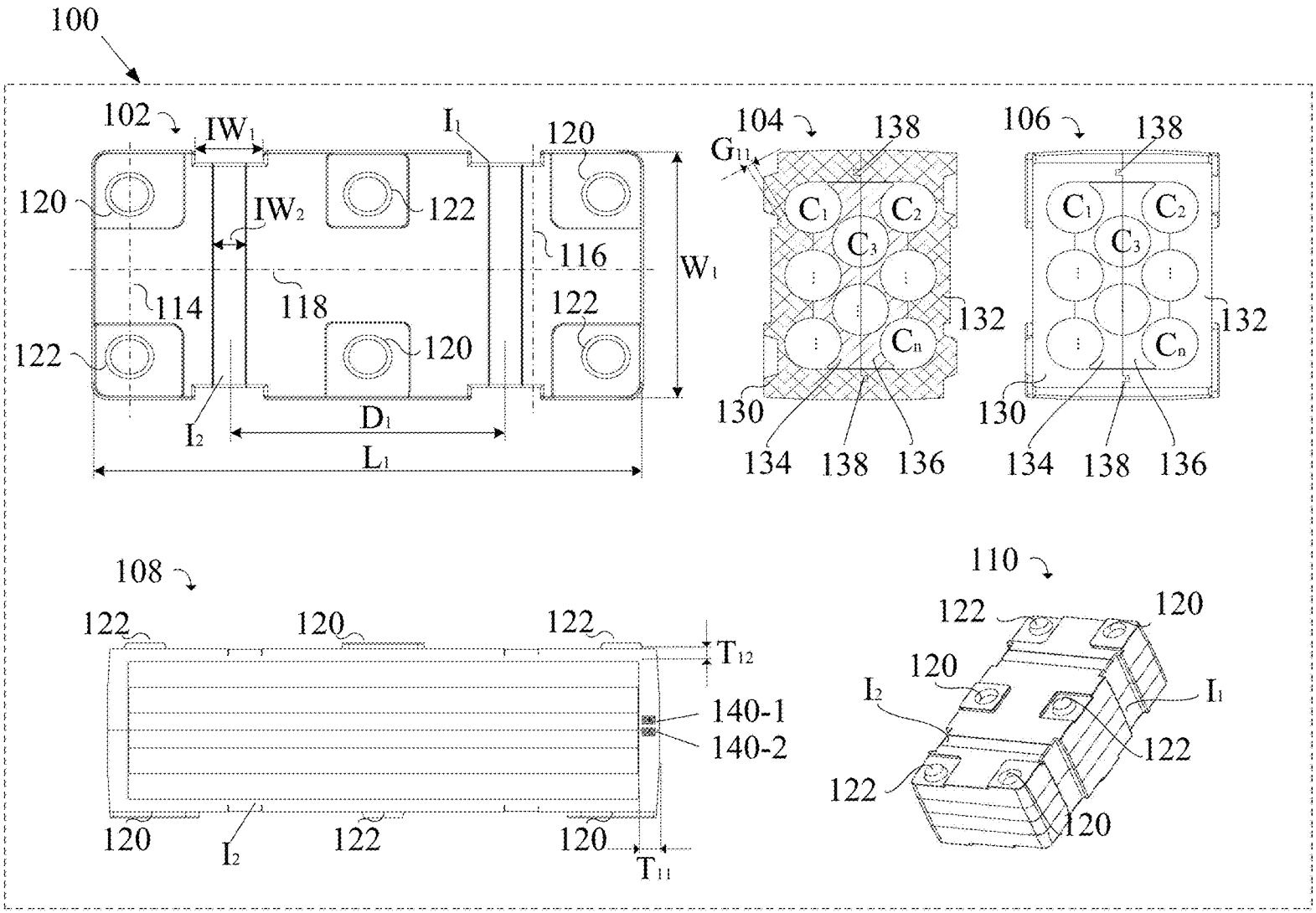
FIG. 1 is a schematic diagram of a munitions packaging system, according to certain embodiments.

In the drawings, like reference numerals designate identical or corresponding parts throughout the several views. Further, as used herein, the words "a," "an" and the like generally carry a meaning of "one or more," unless stated otherwise. The drawings are generally drawn to scale unless specified otherwise or illustrating schematic structures or flowcharts.

Furthermore, the terms "approximately," "approximate," "about," and similar terms generally refer to ranges that include the identified value within a margin of 20%, 10%, or preferably 5%, and any values therebetween.

The polystyrene may be injection molded and/or blow molded to form one or more components of the munitions packaging system.

The munitions packaging system includes a munitions packaging system and, optionally, an electronic tracking device such as an RFID. The munitions packaging system preferably consists of at least two packaging components made from the same lightweight single polymer material, preferably an expanded polyolefin such as expanded polystyrene (EPS) or expanded polypropylene (EPP). In one embodiment, the EPS has a weight average molecular weight (Mw) in a range of 150,000-400,000 g/mol. In another embodiments, the density of the EPS is between 12 $kg/m^3$ and 50 $kg/m^3$. In yet another embodiments, the EPS has the compression strength at 10% Deformation between 100 kPa and 10,000 kPa and the thermal conductivity between 0.01 W/mK and 0.05 W/mK. In some embodiments, the EPS is manufactured by pre-expansion, maturing, and final forming. In another embodiments, the EPS is fire-resistant, water-resistant, impact-resistant, weather-resistant, and/or chemically inert.

Most preferably, the components of the munitions packaging system consist of a single polymer material, e.g., EPS, EPP, etc., and contain no other packing materials or dunnage materials. As used herein the term "consists of" describes a composition that contains only a single polymer, i.e., a polymer defined according to its monomer composition. A composition that contains two EPS polymers that are different only according to physical properties such as density, molecular weight etc., but otherwise are made from the same monomer units, and in the case of copolymers are preferably made from substantially the same ratio of monomers, consists of a single polymer material. A composition that contains the single polymer material in combination with conventional amounts of processing additives such as an antioxidant, release agent, stabilizer etc., preferably in an amount of 1.0 wt % or less, 0.5 wt % or less, 0.2 wt % or less, 0.1 wt % or less, 0.05 wt % or less, 0.01 wt % or less, or 0.005 wt % or less, also consists of a single polymer material.

An advantage from the use of a single polymer material such as EPS for the munitions packaging system relates to the heat signature of the munitions system. For example, a substantially lower heat profile is less likely to be detected by infrared viewing devices. Similarly, the single polymer material is advantageous by exhibiting essentially no electromagnetic signal that is detectable from a distance of greater than 50 meters.

A further advantage of using only EPS as the material for making the munitions packaging system relates to ease of disposal. Unlike conventional munitions packaging systems which contain metal, plastic, and/or wood components that are effectively noncombustible, the munitions packaging system of the present disclosure may be easily disposed by combustion in an open flame such as a campfire.

Moreover, the munitions packaging system has an insulating effect helping to maintain a steady temperature of the munition. This in turn may increase the accuracy and reliability of the munition in use.

In some embodiments, the munition is preferably a deliverable explosive or explosive warhead. The munition may consist of the warhead alone or may be a fixed-type munition that includes both a warhead and a propellant section. In another embodiments, the munition may be a propellant charge, an explosive charge, a sub munition, a guidance kit, and/or an armed mortar round.

Aspects of the invention are described in the drawings and photographs. Referring to FIG. 1, the top view 102 of the munitions packaging system 100 is provided in the top left-hand corner. The munitions packaging system 100 has a generally rectangular or parallelogram profile when viewed from the above with curved corners. In some embodiments, the length $L_1$ of the munitions packaging system 100 may be between 100 mm and 3000 mm, preferably about 800 mm. In another embodiments, the width $W_1$ of the munitions packing system 100 may be between 100 mm and 3000 mm, preferably about 400 mm. The top view 102 identifies several prominent exterior features, such as nesting idents 120, 122 and securing indents $I_1$, $I_2$, that may be present on both the upper portion 130 and lower portion 132 of the munitions packaging system 100. Two sides of the munitions packaging system 100 have securing indents $I_1$, $I_2$ to aid in box movement and storage. These indents may be useful for forklift handling, lifting and securing. The securing indents $I_1$, $I_2$ also provide a means for binding a plurality of munitions packaging systems 100 onto a transport article such as a pallet. The first securing indents $I_1$ have a first securing indent width $IW_1$. Corresponding second securing indents $I_2$ are located on the other sides of the munitions packaging system 100 perpendicular to the plane in which the first securing indents $I_1$ are disposed. The second securing indents $I_2$ have a second securing indent width $IW_2$ that is less than $IW_1$. As shown in FIG. 1, the first securing indent width $IW_2$ may be approximately twice the second securing indent width $IW_2$. The securing indents share a common central axis around the circumference of the munitions packaging system 100. The depth of the respective securing indents is also different. The first securing indent $I_1$ has a depth substantially greater than the depth of the second securing indent $I_2$. For example, the first securing indent $I_1$ may have a depth that is between five and ten times the depth of the second securing indent $I_2$. In some embodiments, the first securing indent width $IW_1$ may be between 10 mm and 500 mm, preferably about 100 mm and the second securing indent width $IW_2$ may be between 10 mm and 250 mm, preferably about 50 mm.

Additional indents may be present on the first and second outer surfaces of the upper and lower portions for purposes of providing handgrips. Handgrip indents are positioned proximal to the outer edge of at least one of the first and second outer surfaces of the munitions packaging system and are preferably continuous along the complete edge of the first and second outer surfaces. Th recesses formed by such indents provide a visible and accessible option for a gripping ang/or holding the munitions packaging system by hand. In one embodiment the munitions packaging system 100 consists of a upper portion 130 and a lower portion 132 each having and inner surface and an outer surface. As shown in the first sectional view 104 with a cutting plane represented by the first cutting plane line 114, the inner surface includes one or more first indents (not shown) in which a munition or other sensitive article may rest snugly. The second sectional view 106 with a cutting plane represented by the second cutting plane line 116 also provides the feature. The inner surface of the upper portion and the inner surface of the lower portion include a mating indent 138 and are complementary such that the upper portion and the lower portion fit together in an interlocking or nesting manner. Preferably, the inner surfaces of the upper and lower portions include indents that form a cavity $C_1, C_2, C_3, \ldots, C_n$ within the packaging device when the upper portion and lower portions are mated. The cavity $C_1, C_2, C_3, \ldots, C_n$ may function as an enclosed space for storage and protection of a munition. Preferably, the munitions packaging system 100 has a plurality of cavities $C_1, C_2, C_3, \ldots, C_n$ for holding and safely storing a plurality of munitions, one munition per enclosed space. In yet another embodiments, the thickness $T_{11}$, $T_{12}$ of the upper portion 130 and the lower portion 132 may be at least 30 mm.

Still referring to FIG. 1, in some embodiments, the munitions packaging system 100 has an electronic tracking device such as an RFID 140-1, 140-2. The first RFID 140-1 is included in the upper portion of the munitions packaging system 100 and the second RFID 140-2 is included in the lower portion of the munitions packaging system 100 as shown in the third sectional view 108 with a cutting plane represented by the third cutting plane line 118. In another embodiments, the first and second RFIDs 140-1, 140-2 are configured to provide information about the munitions packaging system 100, such as an open-closed status, a tracking information, a munition information, and a specification of the munition package 100, when the upper portion 130 and lower portion 132 are mated.

In another embodiment, the RFIDs 140-1 and 140-2 include thin film substrates that extend to the exterior of the upper and lower portions. When the upper and lower portions are mated, the thin film substrates of both RFIDs extend past the first and second outer surfaces of both the upper and lower portions to form a thin film tag. In this embodiment of the thin film tag, one surface of each RFID thin film substrate is directly adjacent and in contact with an opposing surface of the other RFID. The resulting sandwiched tags permits easy access by an individual manipulating or carrying the munitions packaging system. The purpose of exposing the thin film substrates in a tag fashion is to provide an option for quick removal of the RFID and the destruction of any information stored thereon thereof. Quick removal and destruction of the RFID helps prevent loss of sensitive information such as the source and/or other distinguishing features of the munitions packaging system or any munitions stored therein. When in use in the field, after munitions have been removed from the munitions packaging system, an operator can pull the tag presented by the pair of thin film substrates thereby at least partially removing the RFIDs and destroying any sensitive or confidential information stored thereon. In another embodiment, the munitions packaging system 100 includes a munitions package having upper portion 130 and lower portion 132 between which are interposed one or more dimensional layers and/or stacking interlayers 134, 136. Each dimensional layer 134, 136 includes a upper and bottom outer surface that is complementary to an outer surface of the upper portion 130 and/or lower portion 132 of the munitions packaging system 100. Each stacking layer 134, 136 interposed between upper portion 130 and lower portion 132 of the munitions packaging system 100 has outer/edge circumferential dimensions that match the circumferential and/or outer dimensions of the upper and lower portions of the munitions packaging system 100. A munitions packaging system 100 that is assembled from upper and lower portions and one or more stacking interlayers 134, 136 has a sandwich structure in which each of the interposing stacking interlayers 134, 136 nests between the upper and lower portions and each of the outermost layers has a surface that is in direct contact and adjacent to the top section 130 and/or bottom section 132 of the munitions packaging system 100. The stacking interlayers 134, 136 may serve several purposes. First, each stacking interlayer 134, 136 may function as a spacing layer such that a total height of the munitions packaging system (e.g., measured from the outer surface of the lower portion 132 and the outer surface of the upper portion 130) may be adjusted to accommodate munitions of different sizes. The stacking interlayers 134, 136 interpose the bottom surface of the upper portion 130 and the bottom surface of the lower portion 132 such that they are not in direct contact with one another.

As mentioned hereinabove, the upper portion 130 and lower portion 132 interlock/nest into one another to form one or more cavities $C_1, C_2, C_3, \ldots, C_n$ in the munitions packaging system 100. The relative size of the enclosed space may change depending on any interposing layers 134, 136. In some embodiments, the gap $G_{11}$ between the outer most cavity $C_1$ and the outer surface of the upper portion 130 may be greater than 11.85 mm.

Figure 2A:
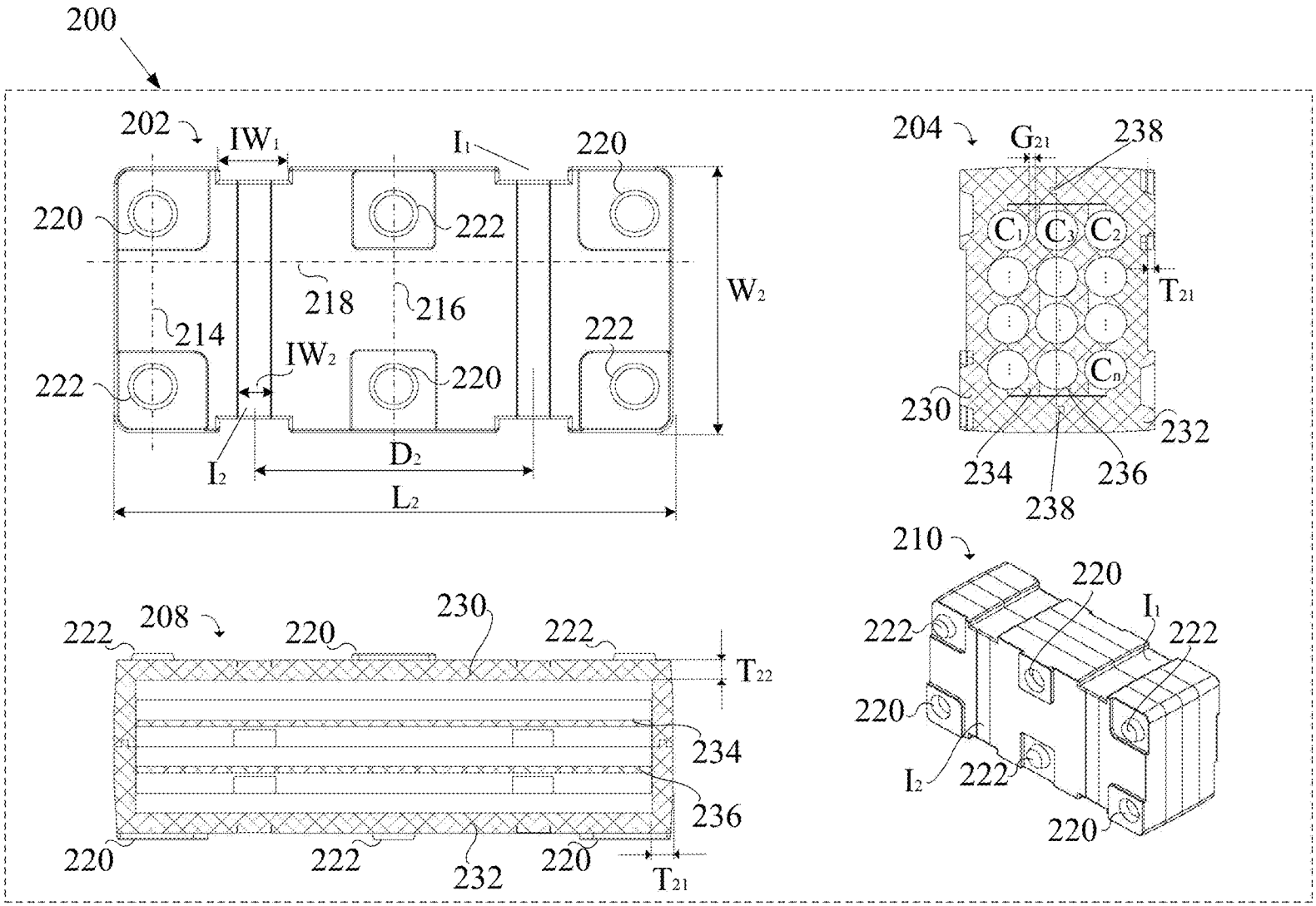
FIG. 2A is a of a schematic diagram of another munitions packaging system, according to certain embodiments.

Referring to FIG. 1 and FIG. 2A, the munitions packaging system 100, 200 preferably includes a plurality of groups of securing indents $I_1$, $I_2$ disposed circumferentially around the munitions packaging system 100, 200. The munitions packaging system 100, 200 has two symmetrically disposed circumferential securing indents $I_1$, $I_2$ which are substantially the same but for their placement on opposites sides of the munitions packaging system 100, 200. Additional circumferential securing indents $I_1$, $I_2$ may be present; preferably at least two securing indents on each side of the munitions packaging system 100 are included to reduce the risk that the munitions packaging system 100, 200 opens during transport. In some embodiments, the distance $D_1$ between the two securing indents $I_1$ or $I_2$ on one side of the munitions packaging system 100, 200 may be between 10 mm and 1000 mm, preferably about 400 mm.

Figure 2B:
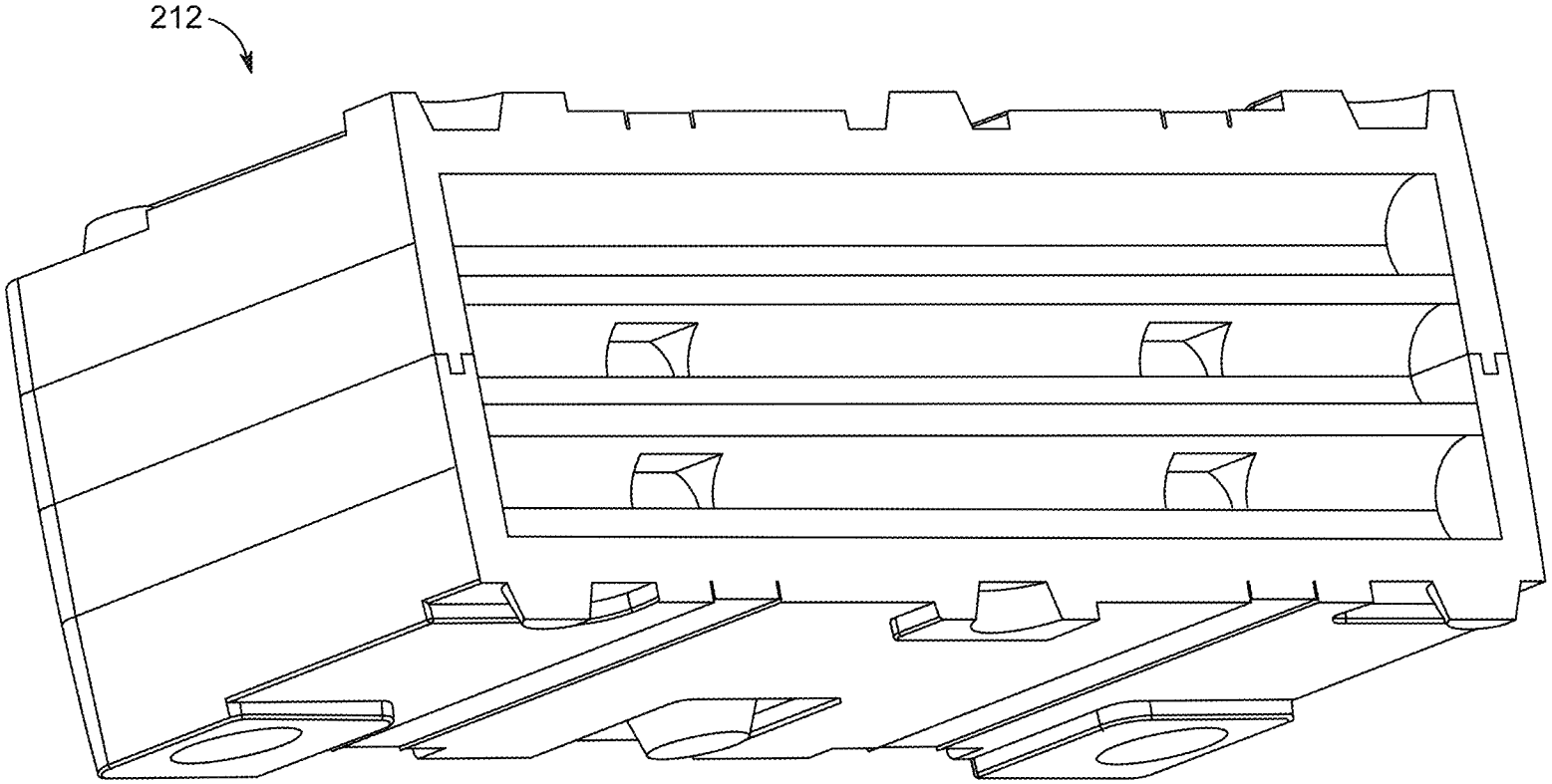
FIG. 2B is an exemplary illustration of a munitions packaging system showing a sectional view, according to certain embodiments.
Figure 2C:
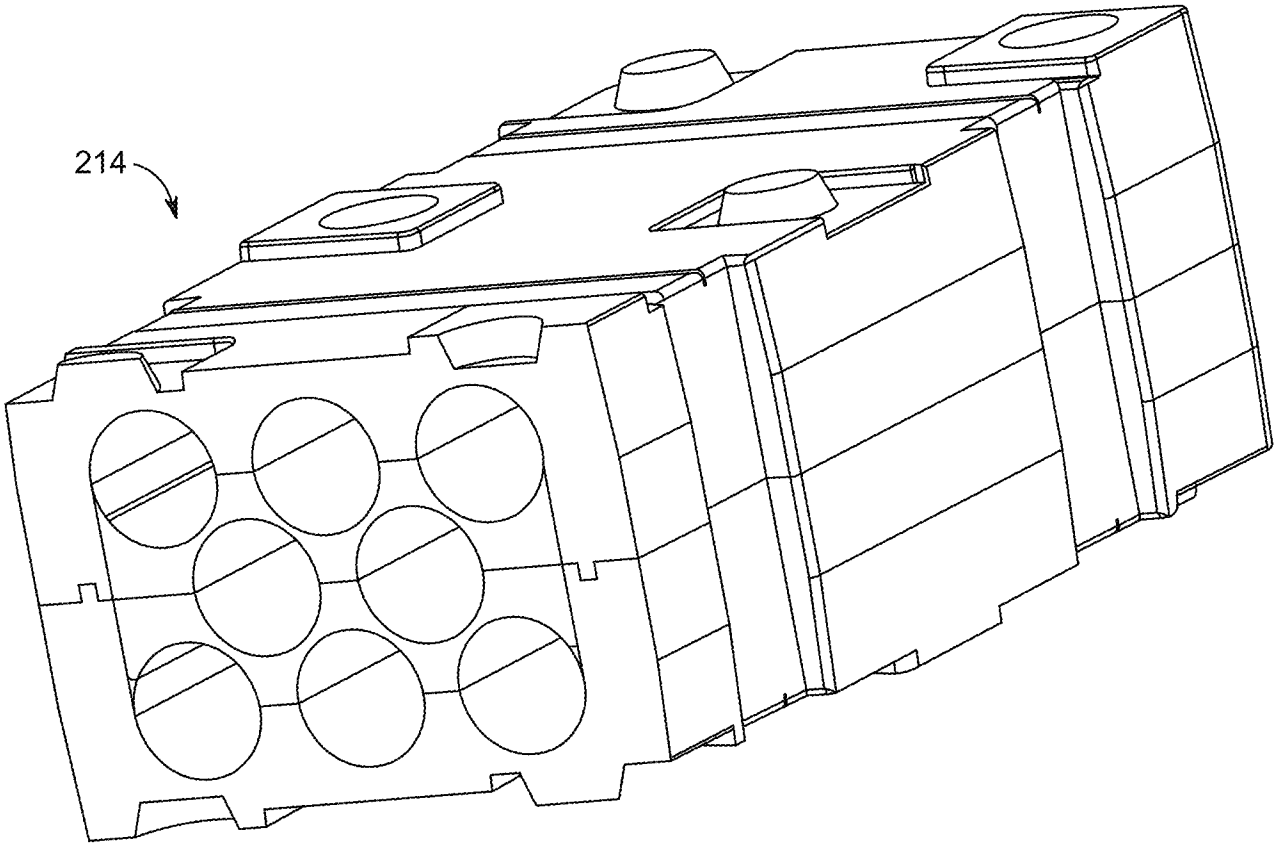
FIG. 2C is an exemplary illustration of a munitions packaging system showing another sectional view, according to certain embodiments.

Also shown in FIGS. 1 and 2 including the top profile view 102, 202, the munitions packaging system 100, 200 has a plurality of nesting projections and recesses 120, 122, 220, 222. As shown in the perspective view 110, 210, 212 in FIGS. 1, 2A, and 2B, this feature includes alternating projections 122, 222 and indents 120, 220, which are in the form of convexes and concaves, on an outer surface of a portion of the munitions packaging system 100, 200. These profiles, preferably circular or cylindrical in the form of both projections and recesses, permit nesting of munitions packaging systems 100, 200 on top of one another or side-by-side. A bottom-most munitions packaging system 100, 200 in a stack of munitions packaging systems 100, 200 will have an upper surface that mates with the lower surface of a neighboring munitions packaging system 100, 200 stacked thereupon. This promotes nesting and stability of munitions packaging systems 100, 200 thereby saving space and stabilizing stacks of munitions packaging systems 100, 200 during transport. In some embodiments, a plurality of nesting projections and recesses 120, 122, 220, 222 are located at regular intervals along the upper portion 130, 230 and lower portion 132, 232 of the munitions packaging system 100, 200.

Referring to FIG. 2A, the fifth sectional view 208 with a cutting plane represented by the fourth cutting plane line 218 of the munitions packaging system 200 illustrates the interlayer nature of the munitions packaging system 200. The fifth sectional view 208 shows an embodiment in which a munitions packaging system 200 has both a upper portion 230 and a lower portion 232 between which are interposed two stacking layers 234, 236. The upper portion 230 and the lower portion 232 are interlocked with the mating indents 238 to form a plurality of cavities $C_1, C_2, C_3, \ldots, C_n$. As already discussed herein, the stacking layers 234, 236 permit adjustment of the height of the munitions packaging system 200 and customization of the cavities $C_1, C_2, C_3, \ldots, C_n$ in the munitions packaging system 200. In some embodiments, the gap $G_{21}$, similarly with the gap $G_{11}$ in FIG. 1, between the first layer of cavities represented as the first column of cavities including the cavity $C_1$ in the fourth sectional view 204 with a cutting plane represented by the fifth cutting plane line 214 of the munitions packaging system 200 and the second layer of cavities represented as the second column of cavities including the cavity $C_3$ in the fourth sectional view 204 may be between 5 mm and 50 mm, preferably about 10 mm. In another embodiments, the radius of the cavities $C_1, C_2, C_3, \ldots, C_n$ may be between 10 mm and 100 mm, preferably about 30 mm. In yet another embodiment, the width $W_2$, the length $L_2$, the distance $D_2$, and the thickness $T_{21}$ and $T_{22}$ of the munitions packaging system 200 may be substantially same with or entirely different from $W_1$, $L_1$, $D_1$, $T_{11}$, and $T_{12}$ of the munitions packaging system 100, respectively.

The fourth sectional view 204 in FIG. 2A shows a plurality of cylindrical cavities $C_1$, $C_2$, $C_3$, . . . , $C_n$ that extend along a long axis of the munitions packaging system 200. A side view of the cylindrical cavities $C_1$, $C_2$, $C_3$, . . . , $C_n$ is provided in the fifth sectional view 208, the first profile view 212 in FIG. 2B, and the second profile view 214 in FIG. 2C. In the embodiment shown, the enclosed cavities $C_1$, $C_2$, $C_3$, . . . , $C_n$ are continuous until meeting outer ends of upper portion 230 and lower portion 232 of the munitions packaging system. As mentioned herein, the cavities $C_1$, $C_2$, $C_3$, . . . , $C_n$ may include separate inserts also made of EPS to divide the cavities $C_1$, $C_2$, $C_3$, . . . , $C_n$ into two or more separate enclosed spaces. In some embodiments, the munitions packaging system 200 may include a rectangular array of 12 cavities similar to the munitions packaging system 100 as shown in the first sectional view 104. In another embodiments, the munitions packaging system 200 may include a different arrangement of the cavities, for example, but not limited to the cavities $C_1$, $C_2$, $C_3$, . . . , $C_n$ shown in the fourth sectional view 204.

Figure 3:
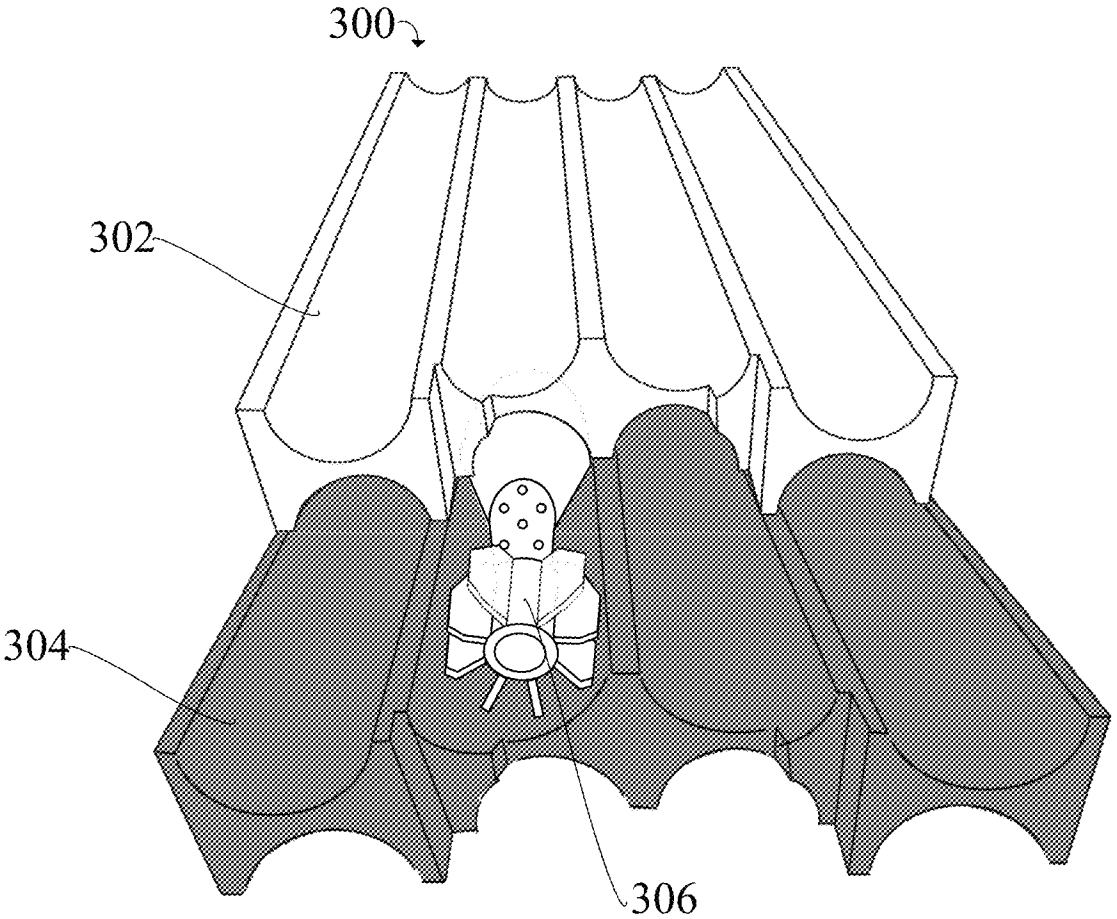
FIG. 3 is an exemplary illustration of an interposing stacking layer, according to certain embodiments.

Referring to FIG. 3, in an embodiment, the interior interposing stacking layer structure 300 of the munitions packaging system 100 includes a bottom interposing stacking layer 304 and a top interposing stacking layer 302 stack on top of one another to form cylindrical enclosed spaces. A mortar round 306 illustrates how a munition is held in place in the munitions packaging system 100.

Figure 4:
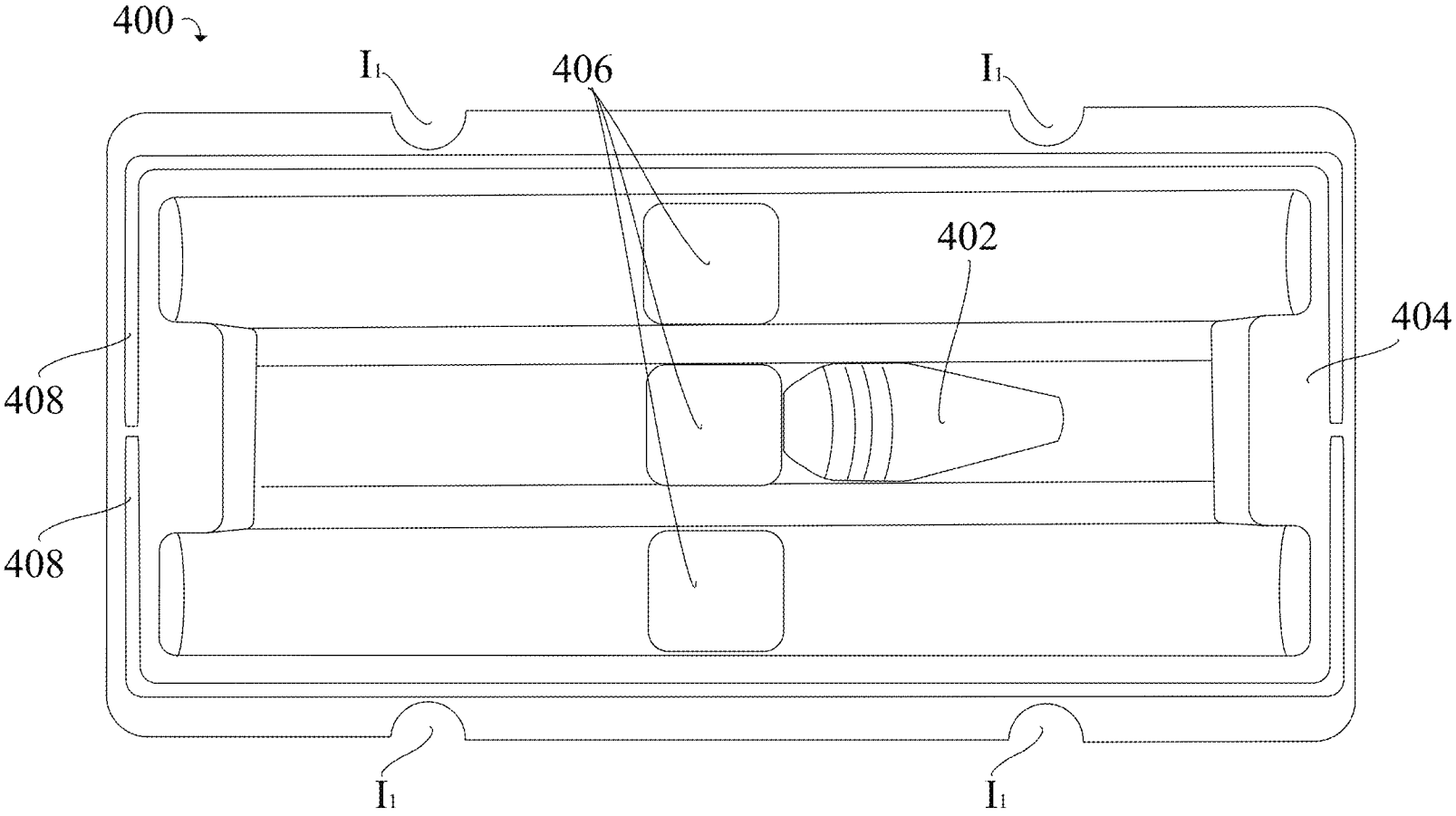
FIG. 4 is an exemplary schematic diagram of a lower portion of a munitions packaging system with three cylindrical cavities each of which are separated by a separator, according to certain embodiments.

FIG. 4 provides a top view 400 of an exemplary lower portion 404 of the munitions packaging system 100. FIG. 4 illustrates an embodiment in which only a warhead 402 is present in the munitions packaging system 100. The exemplary lower portion 404 includes EPS separators 406 which can be used to subdivide the enclosed space and thereby provide separate enclosed spaces for individual munitions or portions thereof. The exemplary lower portion 404 also includes mating indents 408 running along the circumference of the outer edge of the exemplary lower portion 404 of the munitions packaging system 100. The mating indents 408 functions to interlock or mate with a corresponding mating indent in a upper portion (not shown) of the munitions packaging system 100 that is used to complete the munitions packaging system 100. In some embodiments, the securing indents $I_1$ may have a shape of a semicircle as shown in the top view 400.

Figure 5A:
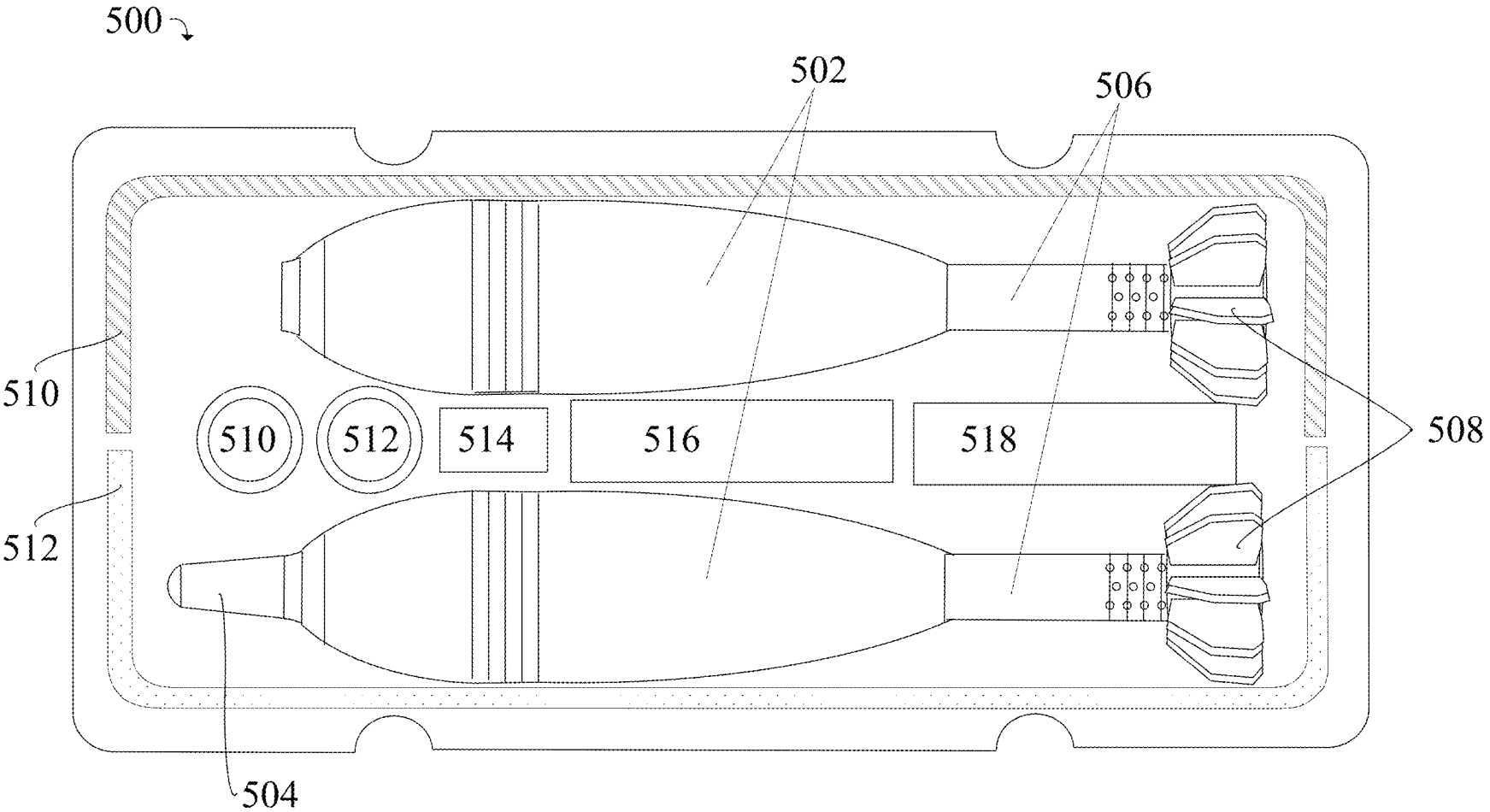
FIG. 5A is another exemplary schematic diagram of a lower portion of a munitions packaging system with a plurality of cavities of different shapes, according to certain embodiments.
Figure 5B:
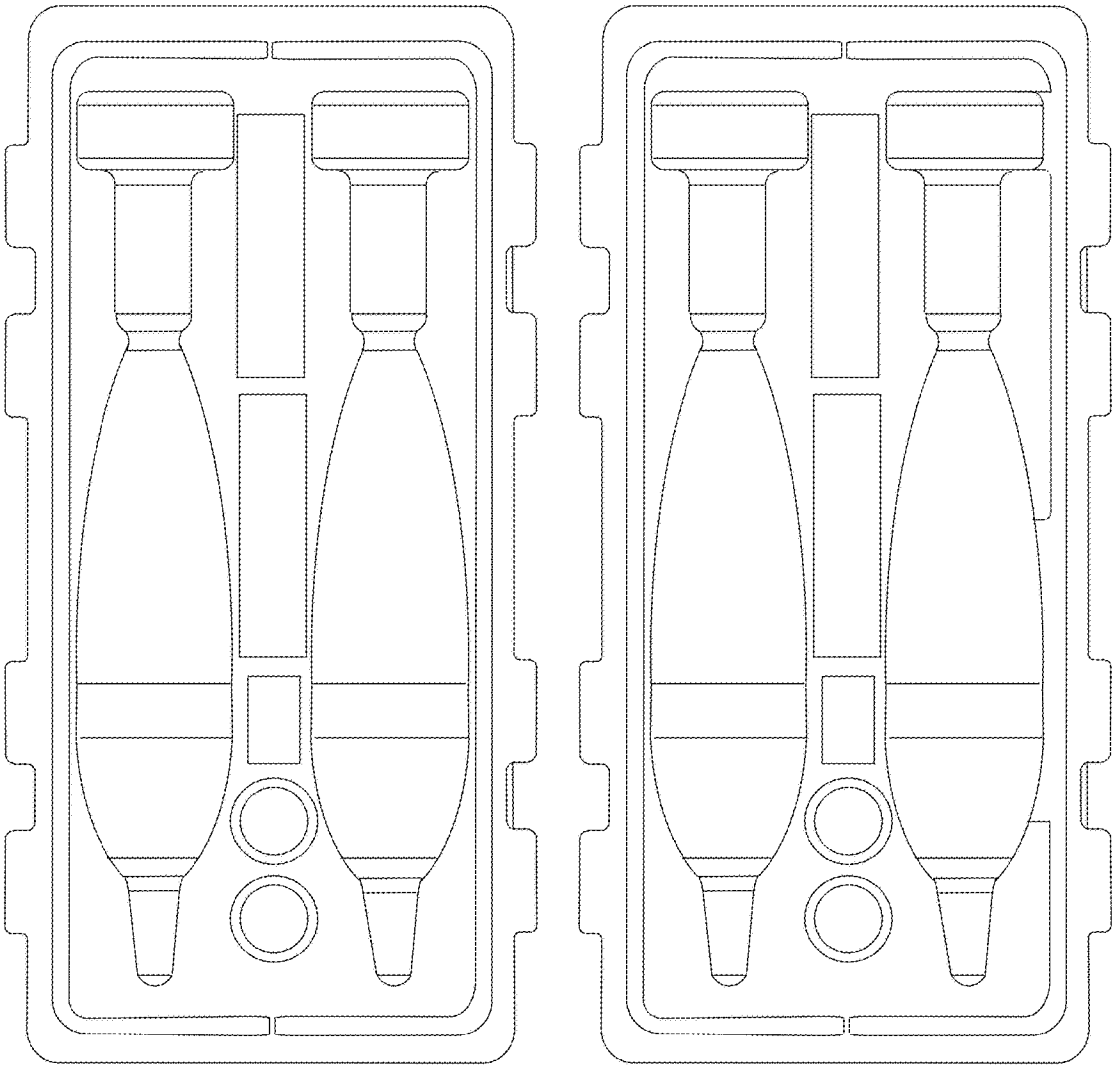
FIG. 5B is another exemplary schematic diagram of a lower portion of a munitions packaging system with a plurality of cavities of different shapes, according to certain embodiments.

FIG. 5A shows a further embodiment of the present invention. Shown is another exemplary lower portion 500 of a munitions packaging system containing two mortar rounds 502 which may optionally include a fuse such as a proximity fuse 504 as well as propellant sections 506 and stabilizing fins 508. The circumferential mating indents 510, 512 around the edge of the lower portion 500 of a munitions packaging system, as alternating projections 510 and recesses 512, make upper and lower portions of a munitions packaging system interchangeable as shown in yet another embodiment shown in FIG. 5B and provide a nesting stabilization function when a lower portion is mated with a upper portion. In some embodiments, a bottom or upper portion includes cavities 510, 512, 514, 516, 518 having an axis running perpendicular with the axis of the cavities dedicated for a munition. These additional cavities 510, 512, 514, 516, 518 may be left empty during transport (for example to reduce the amount of EPS needed to manufacture a munitions packaging system) or may function to include parts which are preferably separated from the mission during transport, such as fuses and detonators. In some embodiments the munitions packaging system includes cavities that function to hold and store propellant charges for munitions such as artillery rounds. In some embodiments each cavity within a munitions packaging system may store and safely separate all of the components necessary for delivering a munition and/or warhead to the targeted which an explosive warhead or explosive charge may rest.

Figure 6:
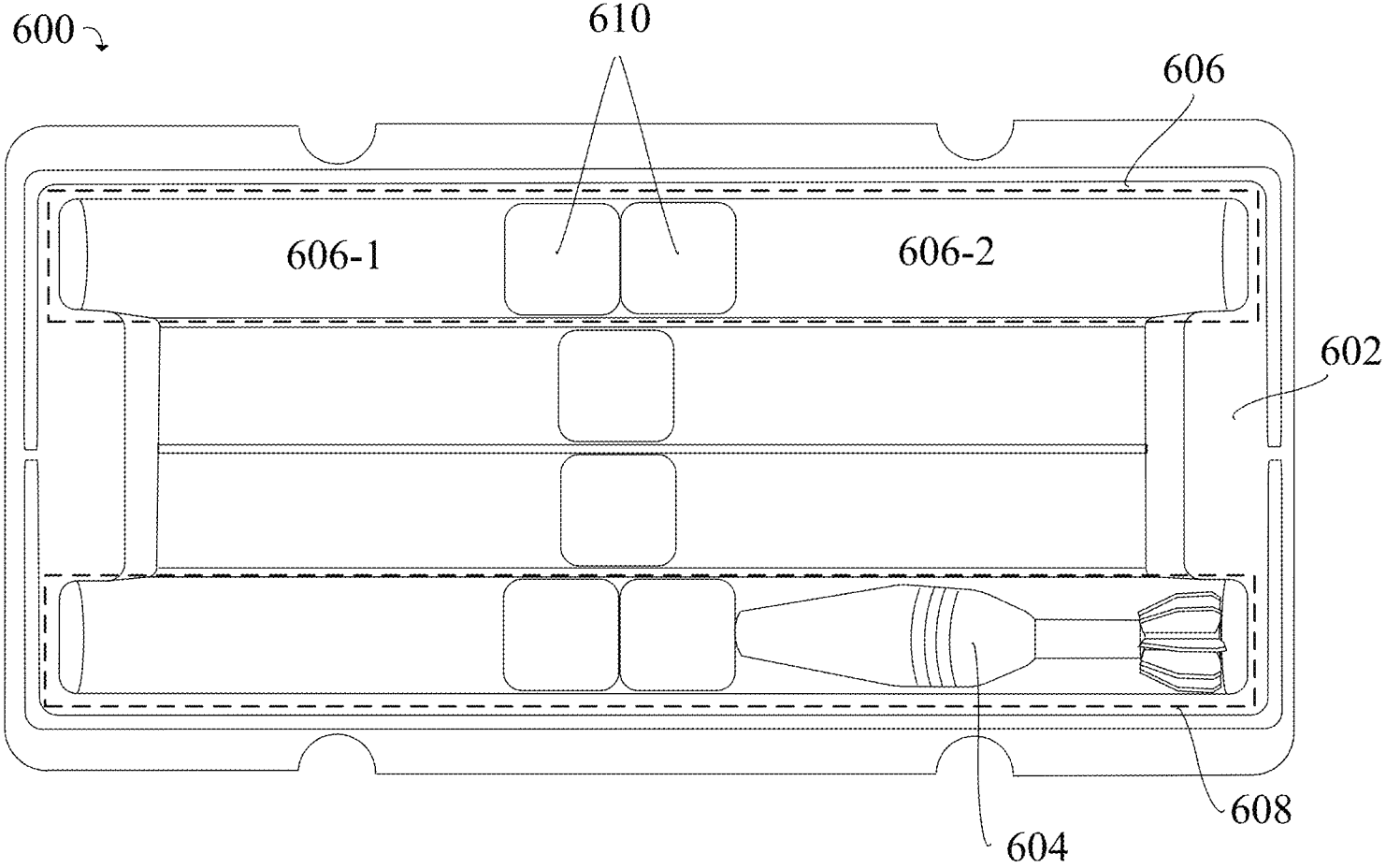
FIG. 6 is yet another exemplary schematic diagram of a lower portion of a munitions packaging system with four cylindrical cavities each of which are separated by a separator, according to certain embodiments.

Turning to FIG. 6, an additional top view of a lower portion 602 of a munitions packaging system containing a single armed mortar round 604 in a cavity such as 606, 608. The cavity 606 may be separated into a first section 606-1 and a second section 606-2 with one or more separators 610 made from the same EPS material used to make the munitions packaging system. Each separator 610 preferably rests and/or nests within the cavity 606 and has a circumference or outer surface that is in continuous contact with the outer surface of the upper and lower portions of the munitions packaging system. A second section 606-2 of the cavity 606 may contain one or more complementary portions of the munition such as a propellant portion, a sub munition, stabilizing fins and/or a guidance kit.

Figure 7:
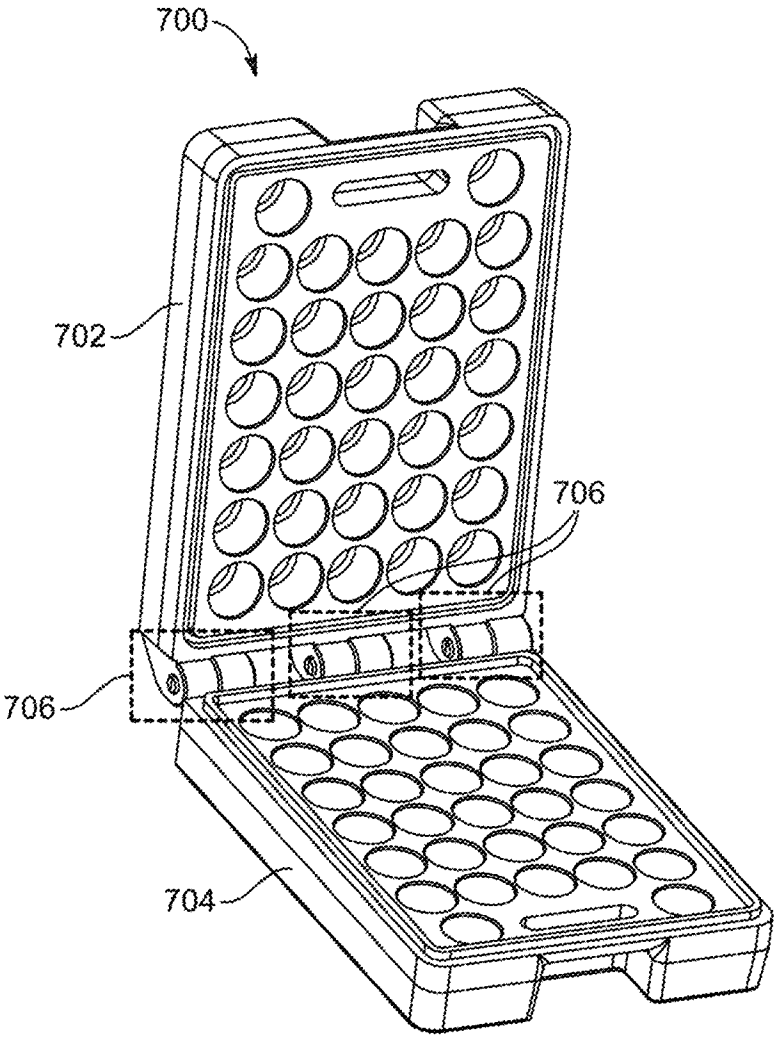
FIG. 7 is an exemplary illustration of a munitions packaging system with hinges, according to certain embodiments.
Figure 8:
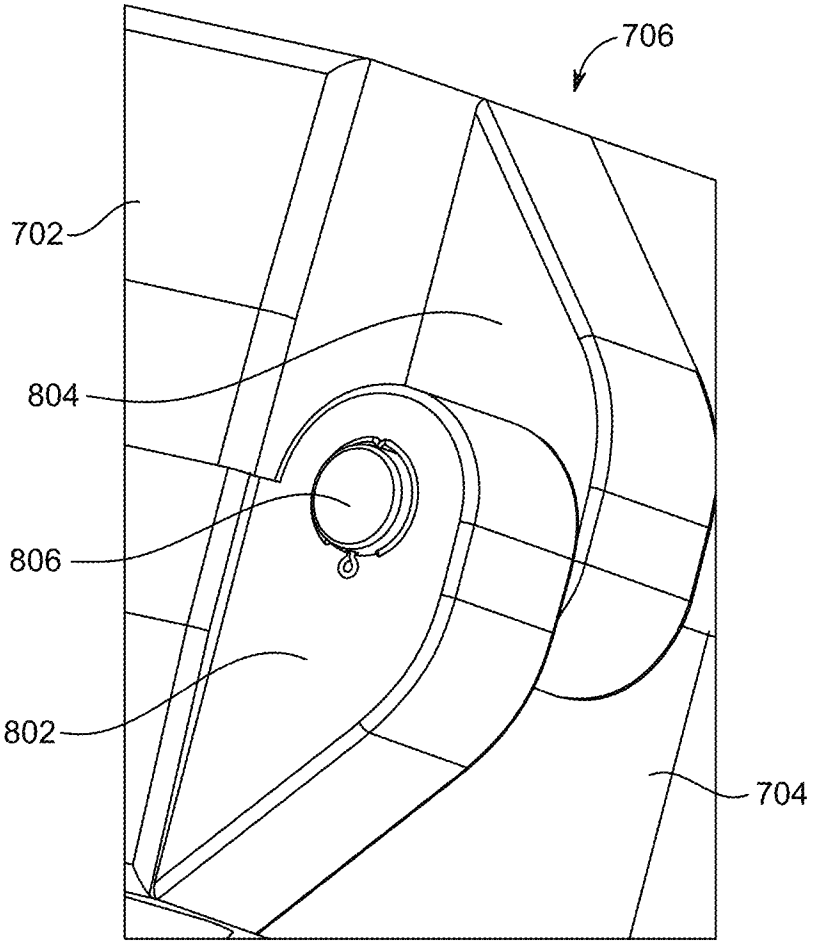
FIG. 8 is an exemplary illustration of a hinge, according to certain embodiments.
Figure 9:
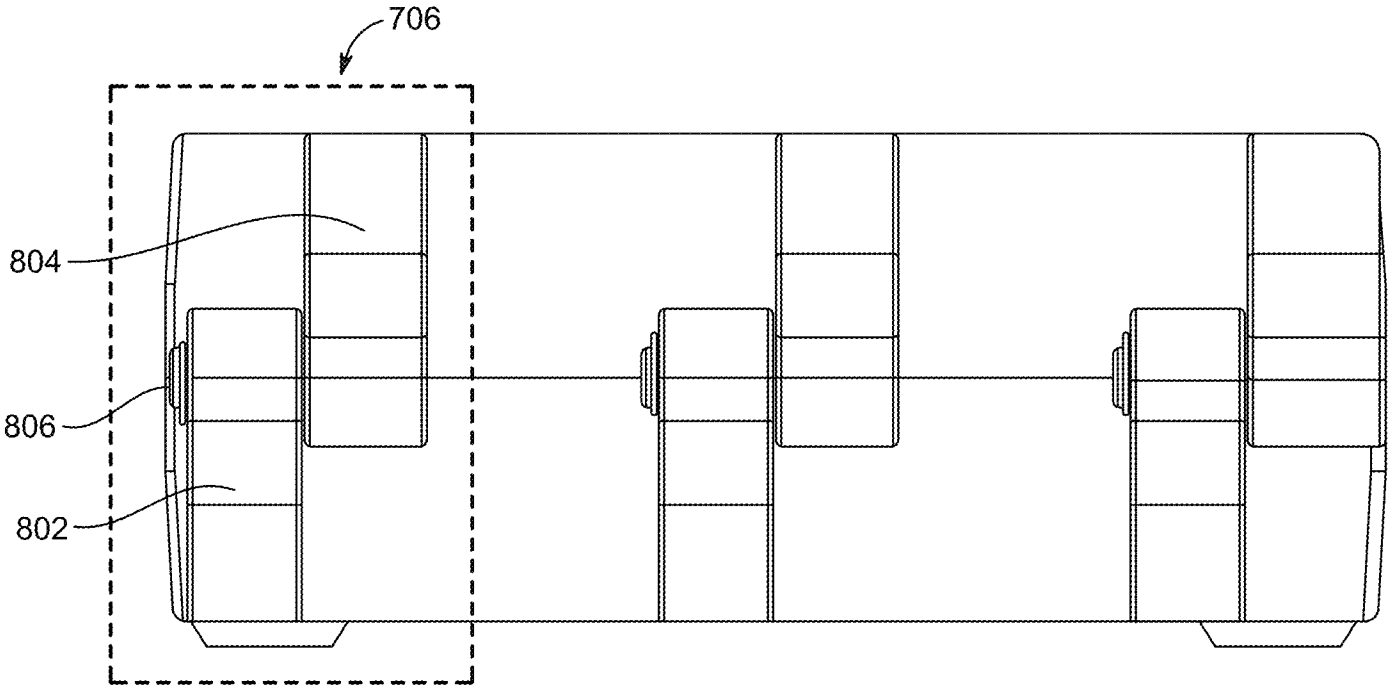
FIG. 9 is an exemplary illustration of a munitions packaging system with hinges showing three hinges in a closed position, according to certain embodiments.
Figure 10:
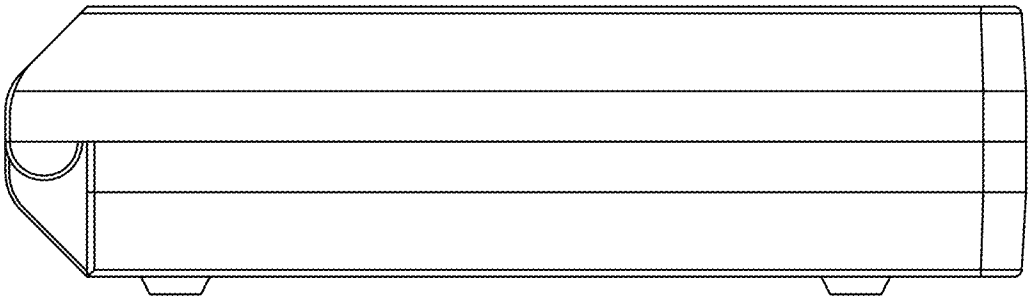
FIG. 10 is an exemplary illustration of a munitions packaging system with hinges showing a side view in a closed position, according to certain embodiments.
Figure 11:
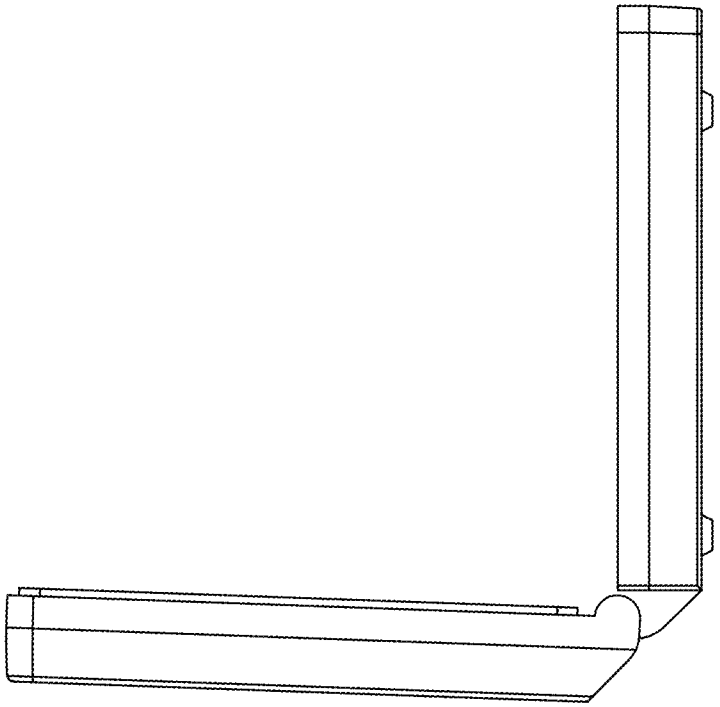
FIG. 11 is an exemplary illustration of a munitions packaging system with hinges showing a side view in an open position, according to certain embodiments.
Figure 12:
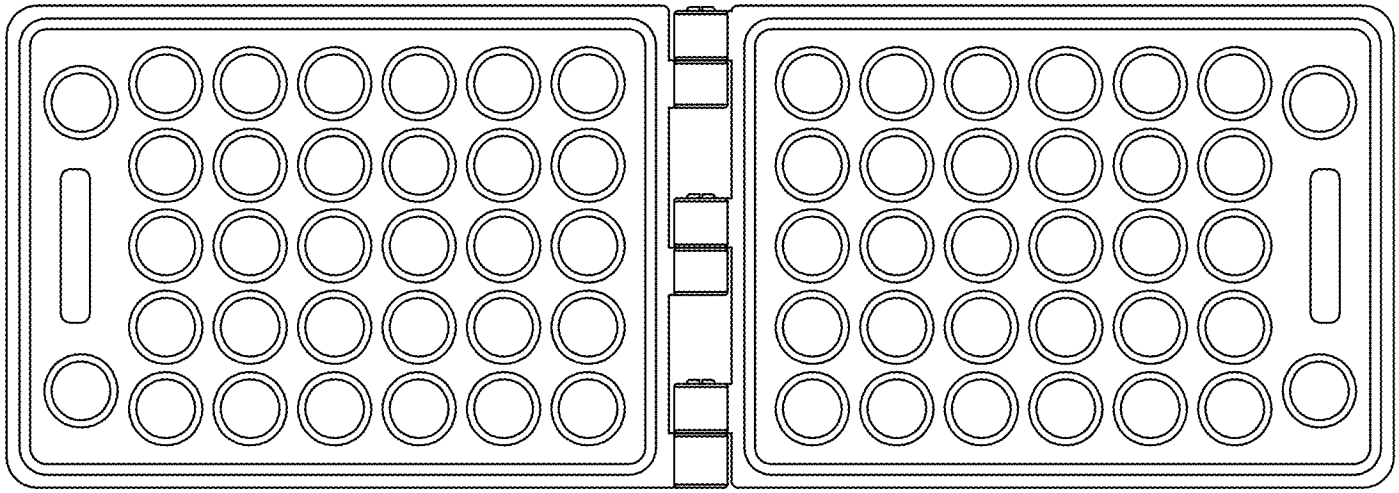
FIG. 12 is an exemplary illustration of a munitions packaging system with hinges showing a top view in a completely open position, according to certain embodiments.

Now referring to FIGS. 7-12, an embodiment of a munitions packaging system may include a plurality of hinges. FIG. 7 shows an embodiment with three hinges 706 on the same side of the upper portion 702 and the lower portion 704 of a munitions packaging system 700 configured to securely connect the upper portion 702 and lower portion 704. As shown in FIG. 8, each hinge 706 comprises a lower hinge 802 protruding from the lower portion and an upper hinge 804 protruding from the upper portion. The lower hinge 802 and the upper hinge 804 are connected by a hinge pin 806 to form the complete hinge 706, thereby enabling the munitions packaging system open and close. When the hinge 706 is closed, the upper portion 702 and the lower portion 704 are juxtaposed (i.e., side-by-side) as shown in FIG. 9. Hinge 706 can be opened to position the upper portion 702 and the lower portion 704 in different relative positions to each other as shown in FIGS. 10-12.

In other aspects a hinged munitions packaging system may include a plurality of hinges such as those 706 in FIG. 7. Preferably the hinge components are formed of the same material (e.g., EPS, EPP, etc.) used to form the upper and lower portions of the munitions packaging system. The hinge elements may include a plurality of protrusions that are offset with respect to the upper and lower portions and extending along one edge of the munitions packaging system. Preferably the hinge elements form a continuous hinge of interfitting hinge elements along one edge of the munitions packaging system when the upper and lower portions are mated. The hinge elements may have one or more separate hinge rods passing therethrough to keep the upper and lower portions together on the munitions packaging system when in an open or closed orientation. The hinge rod is preferably made of the same polymer material used to form the upper and lower portions. In another embodiment the upper and lower portions include protrusions in the form of hooks and loops such that hooks along one edge of one portion of the munitions packaging system are inserted in corresponding loops in the opposite portion thereby functioning as a disassemblable hinge.

In still a further embodiment, the upper and lower portions include a handle section, preferably opposite the aforementioned hinge elements, configured to permit an individual to grip and lift a munitions packaging system by hand. This aspect of the invention is shown, in part, in FIG. 7. An inset on one side opposite the side on which a hinge is present, forms an exterior cavity sufficient for accommodating a hand grip when the upper and lower portions are closed/mated. Alternately, one or more compression elements may be present to provide a locking mechanism whereby the upper and lower portions of the munitions packaging system or held together when in a closed position. A further embodiment of the invention relates to a method of packaging and transporting munitions for delivery to the battlefield or pre-battle staging ground. This embodiment of the invention includes placing one or more munitions in a munitions packaging system as disclosed herein. The munitions packaging system is preferably assembled as needed based on pre-formed upper and lower portions as well as interlayer stackings. Depending on the size, functionality and caliber of the munitions, a packaging technician may quickly and easily assemble a munitions packaging system, optionally with customization, to accommodate one or more munitions for delivery.

A completed munitions packaging system is substantially lower in weight than a conventional munitions packaging system and thus permits easier handling during loading and transport. After a munitions packaging system has been fully or completely filled with munitions and includes both upper and bottom nested portions, optionally with interlayer stackings, individual munitions packaging systems may be collected and stacked. As noted herein, the nesting or interlocking profiles provided on the outer surfaces of the upper and lower portions permit stable stacking of a plurality of munitions packaging systems. Additionally, the dimensional stability of EPS permits stacking multiple pallets, each pallet including stacked munitions packaging systems, on top of one another. A plurality of munitions packaging systems stacked on top of a pallet may be further stabilized by ribonning or otherwise including strapping that passes around the circumferential indents of the exposed surfaces of munitions packaging systems on the pallet.

Figure 13:
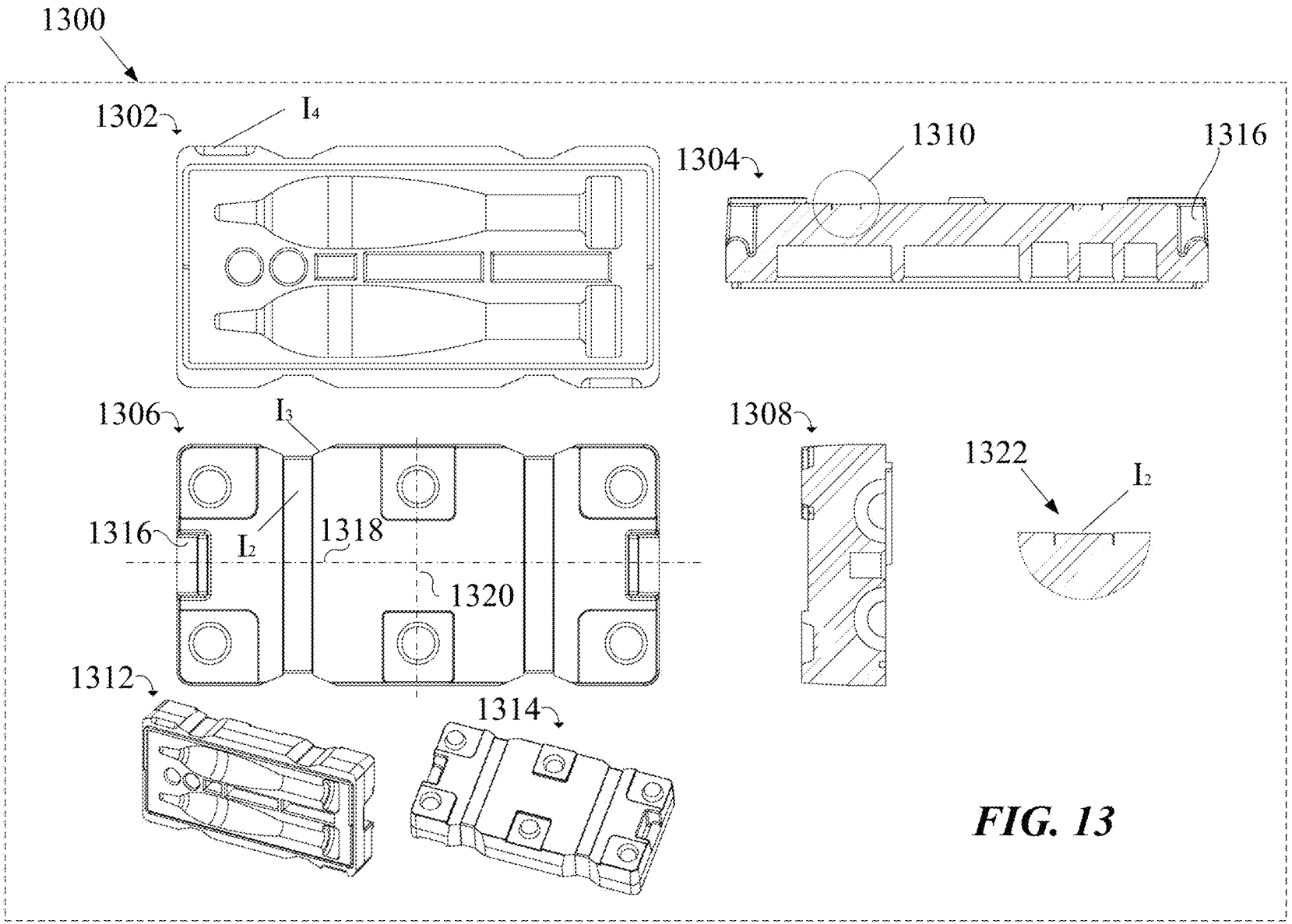
FIG. 13 is an exemplary illustration of a munitions packaging system with handles, according to certain embodiments.

Referring to FIG. 13, shown is another exemplary embodiment of a munitions packaging system 1300 with hand grips 1316 and handle indentations $I_4$. The first top view 1302 of the lower portion of the munitions packaging system 1300 shows a handle indentation $I_4$, allowing end-users to open the munitions packaging system 1300 with ease.

The second top view 1306 of the upper portion of the munitions packaging system 1300 shows another exemplary embodiment of securing indents $I_3$. The securing indents $I_3$ perform similar functionality with the securing indents $I_1$, $I_2$, of the munitions packaging system 100 of FIG. 1, but the securing indents $I_3$ exhibit a shape of an open trapezoid. In some embodiments, the securing indents $I_3$ have a shape of a semi-circle, a triangle, a rectangle, a square, a reverse-trapezoid, or any other shapes. The munitions packaging system 1300 also shows the aforementioned hand grips 1316. A portion of the munitions packaging system 1300 is cut to form the hand grips 1316 as shown in the perspective views 1312, 1314. As shown in the sectional view 1304 with a cutting plane represented by the sixth cutting plane line 1318, the hand grips 1316 have a shape for users to grab the munitions packaging system 1300 with hands conveniently. The sectional view 1308 with a cutting plane represented by the seventh cutting plane line 1320 and the magnified view 1322 exhibiting the securing indents $I_2$ are presented to provide additional structural information.

Figure 14:
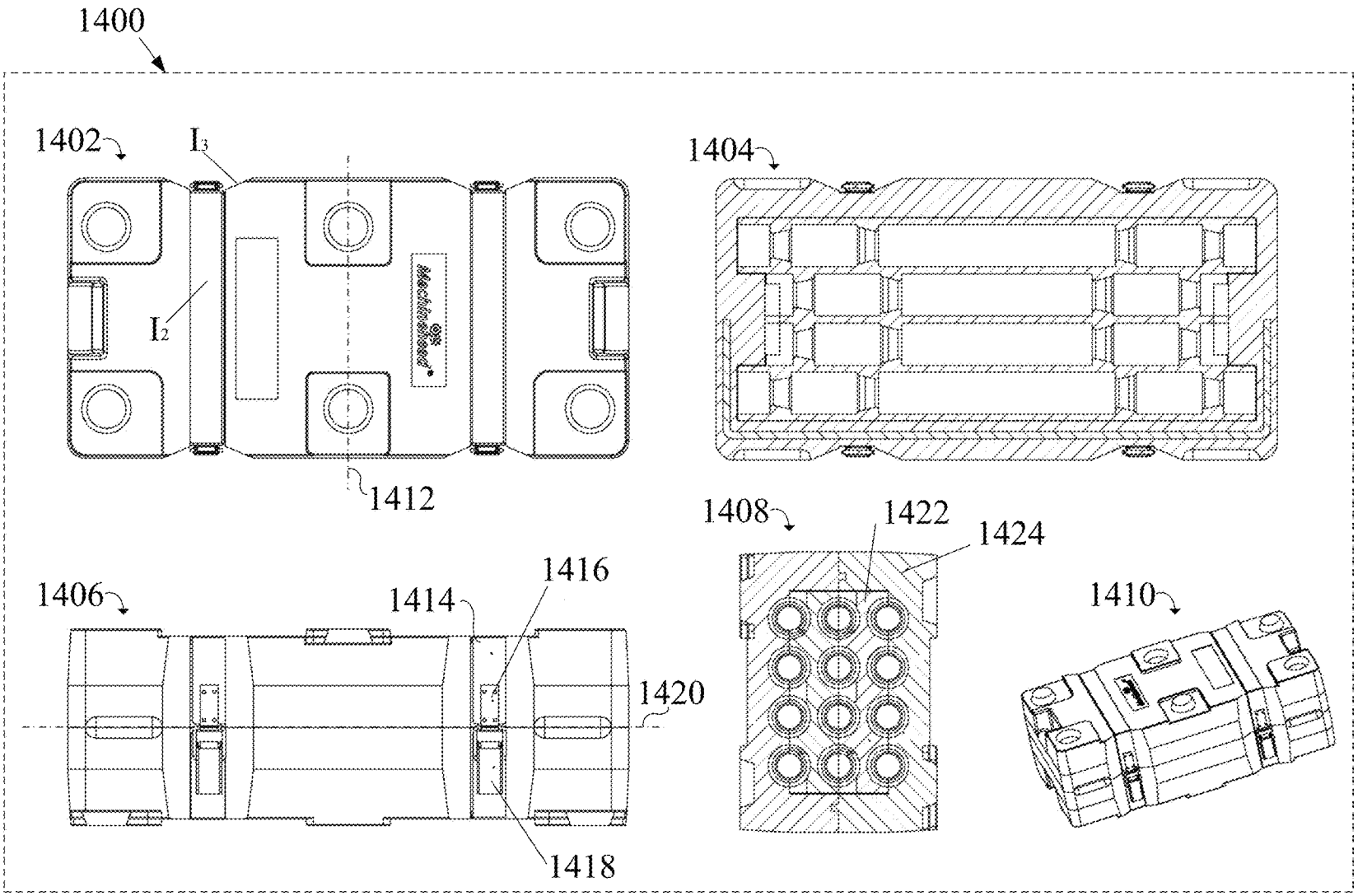
FIG. 14 is an exemplary illustration of a munitions packaging system with 12 total cavities and steel ties, according to certain embodiments.
Figure 15:
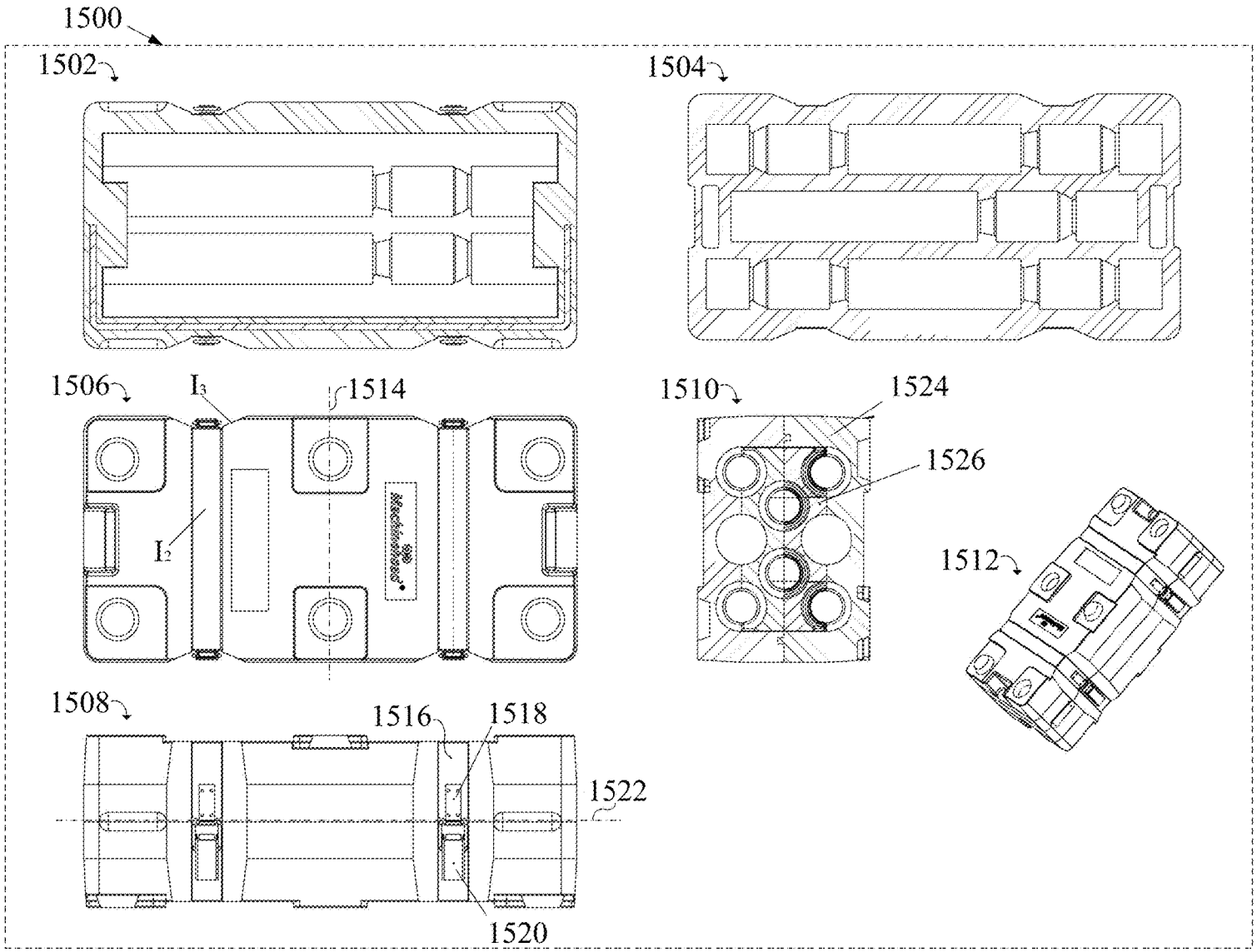
FIG. 15 is an exemplary illustration of a munitions packaging system with 8 total cavities and steel ties, according to certain embodiments.

FIGS. 14 and 15 show other exemplary embodiments of munitions packaging systems 1400, 1500 with two outer portions 1424, 1524 and two inner portions 1422, 1526 as shown in sectional views 1408, 1510 with a cutting plane represented by the eighth and nineth cutting plane line 1412, 1514. Similar to the munitions packaging system 1300 of FIG. 13, the munitions packaging systems 1400, 1500 include the securing indents $I_2$, $I_3$ as shown in top views 1402, 1506. Furthermore, the munitions packaging systems 1400, 1500 are wrapped with steel ties comprising steel chambers 1414, 1516, steel hooks 1416, 1518, and steel clasps 1418, 1520. The steel ties provide additional security to the munitions packaging systems 1400, 1500 when, including but not limited to, munitions inside the munitions packaging systems 1400, 1500 are heavy. Sectional views 1404, 1502 (the outer portion 1524), 1504 (the inner portion 1526) with cutting planes represented by the tenth and eleventh cutting plane lines 1420 (for 1404), 1522 (for 1502 and 1504) and perspective views 1410, 1512 are shown to provide additional structural information.

Numerous modifications and variations of the present disclosure are possible in light of the above teachings. It is therefore to be understood that within the scope of the appended claims, the invention may be practiced otherwise than as specifically described herein.

The invention claimed is:

1. A munitions packaging system, comprising:

an upper portion having a first inner surface, a first outer surface, and a plurality of upper portion side surfaces; and a lower portion having a second inner surface, a second outer surface, and a plurality of lower portion side surfaces;

one or more interposing stacking layers each having a first thickness and a first perimetral dimension, wherein the first perimetral dimension is substantially the same as a second perimetral dimension of the upper portion and the lower portion;

wherein the first inner surface of the upper portion and the second inner surface of the lower portion include a plurality of mating indents complementary to fit together in interlocking manner;

wherein the first and second inner surfaces include one or more first indents to form one or more cavities for storage and protection of one or more munitions within the munitions packaging system when the upper portion and lower portion are mated; and wherein the entire munitions packaging system consists of a first single polymer material, wherein each of the one or more interposing stacking layers includes one or more second indents to form the one or more cavities for storage and protection of the one or more munitions within the munitions packaging system when the upper portion, the lower portion, and the one or more interposing stacking layers are mated, wherein each cavity of the one or more cavities has a first section and a second section;

wherein the first section and the second section are separated with one or more separators consisting of the single polymer material;

wherein each separator of the one or more separators has a second thickness substantially same as the first thickness;

wherein the munitions packaging system includes a plurality of groups of securing indents disposed perimetrically around the munitions packaging system symmetrically placed on opposite sides of the munitions packaging system;

wherein the one or more munitions is selected from the group consisting of a warhead, a propellant section, a fixed-type munition, a propellant charge, an explosive charge, a sub munition, a guidance kit, and an armed mortar round;

wherein each cavity of the one or more cavities has the shape configured to fit each one or more munitions;

wherein the upper portion further includes a first RFID device of a plurality of RFID devices;

wherein the lower portion further includes a second RFID device of the plurality of RFID devices;

wherein the first and second RFID devices are configured to provide a packaging information about the munitions packaging system; and wherein the packaging information includes an open-closed status, a tracking information, a munition information, and a specification of the munition packaging system.

2. The munitions packaging system of claim 1, wherein the first and second outer surfaces include a plurality of nesting depressions and protrusions.

3. The munitions packaging system of claim 2, wherein the plurality of nesting depressions and protrusions includes alternating convexes and concaves complementary to each other to stack a plurality of the munitions packaging systems.

4. The munitions packaging system of claim 3, wherein the plurality of nesting depressions and protrusions is cylindrical and located at regular intervals.

5. The munitions packaging system of claim 1, wherein the single polymer material is an expanded polystyrene having a first average molecular weight between 150,000 g/mol and 400,000 g/mol.

6. The munitions packaging system of claim 1, wherein the one or more interposing stacking layers consist of the single polymer material.

7. The munitions packaging system of claim 1, wherein the munitions packaging system includes a plurality of groups of securing indents disposed perimetrically around the munitions packaging system, wherein the plurality of groups of securing indents is symmetrically placed on opposite sides of the munitions packaging system.

8. The munitions packaging system of claim 1, wherein the one or more munitions is selected from the group consisting of a warhead, a propellant section, a fixed-type munition, a propellant charge, an explosive charge, a sub munition, a guidance kit, and an armed mortar round, wherein each cavity of the one or more cavities has a shape dimensionally configured to the one or more munitions.

9. The munitions packaging system of claim 1, further comprising an electronic tracking device.

10. The munitions packaging system of claim 9, wherein the electronic tracking device is a plurality of Radio Frequency Identification (RFID) devices.

11. The munitions packaging system of claim 10, wherein the upper portion further includes a first RFID device of the plurality of RFID devices;

wherein the lower portion further includes a second RFID device of the plurality of RFID devices;

wherein the first and second RFID devices are configured to provide a packaging information about the munitions packaging system; and wherein the packaging information includes an open-close status, a tracking information, a munition information, and a specification of the munition packaging system.

12. The munitions packaging system of claim 1, wherein the upper portion and the lower portion further comprise a one or more hinges consisting of the first single polymer material disposed on at least one edge.

13. The munitions packaging system of claim 1, wherein the upper portion and the lower portion further comprise a plurality of handle indentations.

14. The munitions packaging system of claim 1, wherein the upper portion and the lower portion further comprise a plurality of hand grips.

* * * * *